US012807392B2

(12) United States Patent
Satonaka

(10) Patent No.: US 12,807,392 B2
(45) Date of Patent: Nov. 24, 2026

(54) HOPPER DEVICE

(71) Applicant: United Semiconductor Japan Co., Ltd., Kuwana (JP)

(72) Inventor: Takihiko Satonaka, Yokohama (JP)

(73) Assignee: United Semiconductor Japan Co., Ltd., Kuwana (JP)

( * ) Notice: Subject to any disclaimer, the term of this patent is extended or adjusted under 35 U.S.C. 154(b) by 104 days.

(21) Appl. No.: 18/940,759

(22) Filed: Nov. 7, 2024

(65) Prior Publication Data

US 2025/0197093 A1 Jun. 19, 2025

(30) Foreign Application Priority Data

Dec. 19, 2023 (JP) ..... 2023-213641

(51) Int. Cl.
*B65D 83/06* (2006.01)
*B65D 47/00* (2006.01)

(52) U.S. Cl.
CPC ..... *B65D 83/06* (2013.01); *B65D 47/00* (2013.01)

(58) Field of Classification Search
CPC ..... B65D 83/06; B65D 47/00; B65D 88/64; B65D 88/28; B65D 90/00
See application file for complete search history.

(56) References Cited

U.S. PATENT DOCUMENTS 1,968,808 A * 8/1934 Carpenter ..... A21C 11/163 425/287
4,079,849 A * 3/1978 Smith ..... B30B 9/3071 414/813
4,410,111 A * 10/1983 Barger ..... B65D 90/626 222/509
4,601,414 A * 7/1986 Lawson ..... B65D 88/64 52/192

(Continued)

FOREIGN PATENT DOCUMENTS

CN 205222472 U * 5/2016
CN 105668267 A 6/2016

(Continued)

OTHER PUBLICATIONS

Hiroshi Tsunakawa, Ryuichi Aoki, Kenji Kojima, Kohki Matsushima, Journal of the Society of Powder Technology, The Placement of Inserts to Break Arching in Hoppers, Oct. 10, 1978, p. 594-601, vol. 15, No. 10, Society of Powder Technology, Japan.

*Primary Examiner* — Bob Zadeh
(74) *Attorney, Agent, or Firm* — Winston Hsu

(57) ABSTRACT

A hopper device includes a hopper body having an opening and closing portion configured to open and close a discharge port provided on a lower surface of the hopper body to store a material; a wire member having one end connected to the opening and closing portion and movable at least in a vertical direction in conjunction with an opening and closing operation of the discharge port by the opening and closing portion; and a compaction inhibiting member attached to the (Continued)

wire member and movable at least in the vertical direction together with the wire member in conjunction with the opening and closing operation of the discharge port by the opening and closing portion. The compaction inhibiting member is configured to be foldable from an opened state to a downwardly closed state.

24 Claims, 20 Drawing Sheets

(56) References Cited

U.S. PATENT DOCUMENTS

| | | | | | |
|---|---|---|---|---|---|
| 4,620,795 | A * | 11/1986 | Diebold | ..... | B65D 88/68 366/241 |
| 7,461,542 | B2 * | 12/2008 | Weisinger | ..... | G01N 11/06 141/334 |
| 2025/0197093 | A1 * | 6/2025 | Satonaka | ..... | B65D 83/06 |

FOREIGN PATENT DOCUMENTS

| | | | | | |
|---|---|---|---|---|---|
| CN | 107297472 | A | * | 10/2017 | ..... B22D 1/00 |
| CN | 111099392 | A | | 5/2020 | |
| CN | 111169973 | A | | 5/2020 | |
| CN | 113460731 | A | * | 10/2021 | ..... B65D 88/28 |
| CN | 116477210 | A | | 7/2023 | |
| JP | 49-67362 | | | 6/1974 | |
| JP | 58-59130 | A | | 4/1983 | |
| JP | 59-138533 | A | | 8/1984 | |
| JP | 60-38550 | Y2 | | 11/1985 | |
| JP | 60-177124 | U | | 11/1985 | |
| JP | 61-60528 | A | | 3/1986 | |
| JP | 61-17017 | Y2 | | 5/1986 | |
| JP | 2-63393 | U | | 5/1990 | |
| JP | 3-680 | A | | 1/1991 | |
| JP | 4-18290 | A | | 1/1992 | |
| JP | 4-31286 | A | | 2/1992 | |
| JP | 4-49125 | A | | 2/1992 | |
| JP | 4-294779 | A | | 10/1992 | |
| JP | 5-39129 | A | | 2/1993 | |
| JP | 5-65894 | U | | 8/1993 | |
| JP | 6-171693 | A | | 6/1994 | |
| JP | 7-41082 | A | | 2/1995 | |
| JP | 7-76392 | A | | 3/1995 | |
| JP | 7-19193 | U | | 4/1995 | |
| JP | 7-290037 | A | | 11/1995 | |
| JP | 8-207987 | A | | 8/1996 | |
| JP | 8-253292 | A | | 10/1996 | |
| JP | 9-295691 | A | | 11/1997 | |
| JP | 10-29669 | A | | 2/1998 | |
| JP | 11-156106 | A | | 6/1999 | |
| JP | 11-156107 | A | | 6/1999 | |
| JP | 11-197693 | A | | 7/1999 | |
| JP | 2003012266 | A | * | 1/2003 | |
| JP | 2005-75621 | A | | 3/2005 | |
| JP | 2006-289186 | A | | 10/2006 | |
| JP | WO2009116170 | A1 | | 9/2009 | |
| JP | 2011-31963 | A | | 2/2011 | |
| JP | 2013-10576 | A | | 1/2013 | |
| JP | 2019-108174 | A | | 7/2019 | |

* cited by examiner

HOPPER DEVICE

CROSS REFERENCE TO RELATED APPLICATION

This application is based upon and claims priority to Japanese Patent Application No. 2023-213641, filed on Dec. 19, 2023, the entire contents of which are incorporated herein by reference.

BACKGROUND OF THE INVENTION

1. Field of the Invention

The present disclosure relates to a hopper device.

2. Description of the Prior Art

Conventional hopper devices are known for storing and discharging materials to be treated, such as a granular material, a powdery material, or a material to be treated, such as sludge. The hopper device is a device that receives a material to be stored, such as a granular material, a powder material, or a material to be treated, such as sludge from an input port at an upper portion to store the received material and discharges the stored material from a discharge port at a lower portion. In general, the hopper device is configured to have the cross-sectional area of the hopper device narrowing from the input port toward the discharge port. Therefore, when the stored material moves toward the discharge port, the pressure of the stored material increases, and particles, powder, sludge, or the like as the stored material form an arch structure and block the discharge port, which is so-called bridging or compaction. When the bridging or the compaction occurs, the stored material may not be easily discharged from the discharge port. In this case, in order to discharge the stored material stored in the vicinity of the discharge port, it is necessary for an operator to scrape off the stored material remaining in the hopper device using a stick or the like. However, in such a work, a work risk such as sudden falling of the stored material occurs, and a large increase in man-hours occurs due to the time required.

Thus, a mechanism in which a vibration motor is installed on a side surface of the hopper device and vibrations cause the stored material to fall is generally used.

Further, Patent Document 1 discloses a technique in which a wire is disposed in a hopper, and when contents fall in the hopper, the contents are collided with the wire to be decomposed and crushed.

Patent Document 2 discloses a technique in which a conical outflow restrictor is suspended in a hopper by a wire so as to be freely movable, and the outflow restrictor is swung by a stored material flowing toward a discharge port, thereby preventing the bridging at the discharge port.

Patent Document 3 discloses a technique in which a vibrator is connected to an elevator via a cable so as to be vertically movable in a hopper, thereby vibrating the vibrator.

Patent Document 4 discloses a technique for preventing the occurrence of bridging by suspending a cylindrical body in a hopper with a wire such that the cylindrical body can move freely, causing the cylindrical body to move freely due to a powdery material passing between the inner wall of the hopper and the cylindrical body.

RELATED ART DOCUMENTS

Patent Documents

[Patent Document 1] Japanese Unexamined Patent Application Publication No. 4-31286

[Patent Document 2] Japanese Examined Utility Model (Registration) Application Publication No. 61-17017

[Patent Document 3] Japanese Unexamined Patent Application Publication No. 7-76392

[Patent Document 4] Japanese Examined Utility Model (Registration) Application Publication No. 60-38550

However, in the case of the technique using the vibration motor or the technique disclosed in Patent Document 3, power is required, and the contents may not easily fall depending on the degree of solidification of the stored material. Further, when the vibration motor is installed on the side surface of the hopper device, there is a concern that adverse effects such as deterioration of the hopper device due to vibration may occur.

In the case of the technique disclosed in Patent Document 1, the contents may fail to be decomposed or crushed unless the contents fall, and therefore, if the contents are solidified, the contents will not be discharged in some cases.

In the technique disclosed in Patent Document 2, the outflow restrictor is freely movable, but is swung by the stored material flowing toward the discharge port. Therefore, the outflow restrictor is not swung unless the stored material flows, and the stored material may not be discharged.

In the technique disclosed in Patent Document 4, the cylindrical body is freely movable, but the cylindrical body is moved by the powdery material passing between the inner wall of the hopper and the cylindrical body. Therefore, when the powdery material is solidified, the powdery material may not be discharged.

The present disclosure has been made in view of the above-described conventional techniques, and it is desirable to provide a hopper device capable of easily discharging a stored material without using power of a motor or the like.

SUMMARY OF THE INVENTION

According to the present disclosure, a hopper device is provided. The hopper device includes:

- a hopper body having an opening and closing portion configured to open and close a discharge port provided on a lower surface of the hopper body to store a material;
- a wire member having one end connected to the opening and closing portion and movable at least in a vertical direction in conjunction with an opening and closing operation of the discharge port by the opening and closing portion; and
- a compaction inhibiting member attached to the wire member and movable at least in the vertical direction together with the wire member in conjunction with the opening and closing operation of the discharge port by the opening and closing portion, wherein the compaction inhibiting member is configured to be foldable from an opened state to a downwardly closed state.

In the configuration according to the present disclosure as described above, the stored material is discharged from the discharge port while the bridging or compaction of the stored material in the hopper body is inhibited. At this point, since the compaction inhibiting member is configured to be foldable so as to be closed downward from the opened state, the compaction inhibiting member is brought into the downwardly closed state by the opening and closing operation of the opening and closing portion, the weight of the stored material, or the like, and moves downward. This does not hinder the stored material from falling, and the stored material is more easily pushed out downward.

The object and advantages of the invention will be realized and attained by means of the elements and combinations particularly pointed out in the claims.

It is to be understood that both the foregoing general description and the following detailed description are exemplary and explanatory and are not restrictive of the invention.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, embodiments of the present disclosure will be described with reference to the drawings.

First Embodiment

<Configuration of Hopper Device>

Figure 1:
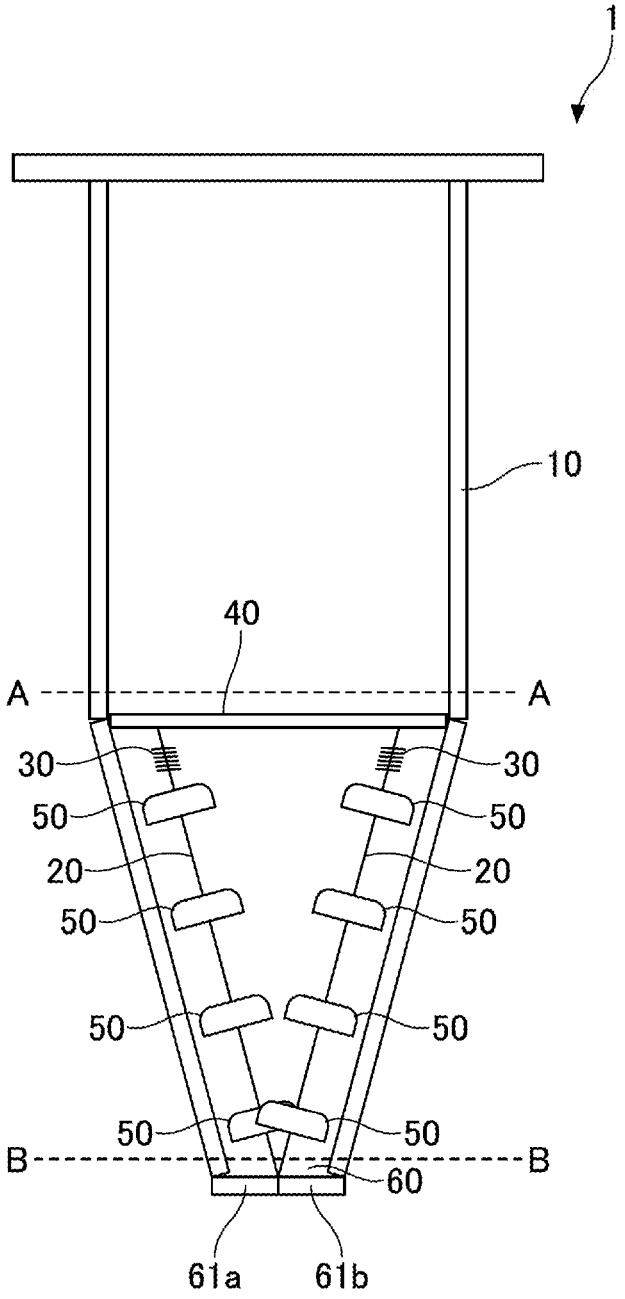
FIG. 1 is a front perspective view of a hopper device according to an embodiment of the present disclosure.
Figure 2:
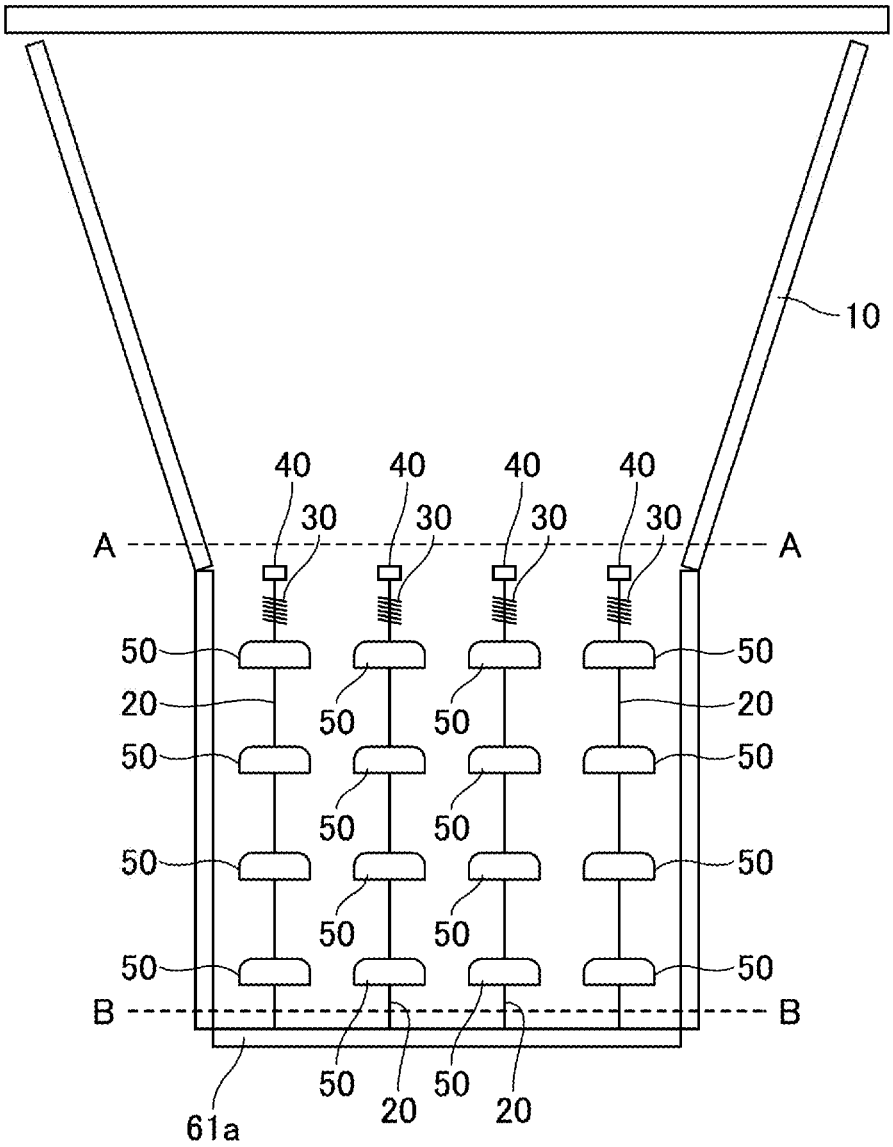
FIG. 2 is a side perspective view of the hopper device illustrated in FIG. 1.
Figure 3:
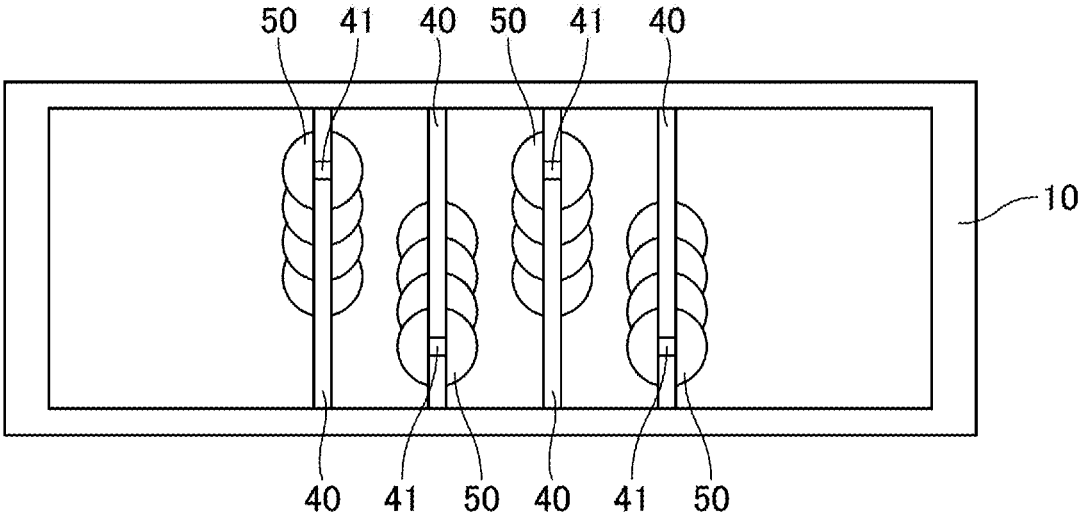
FIG. 3 is a top projection view of the hopper device as viewed from the line A-A illustrated in FIG. 1.
Figure 4:
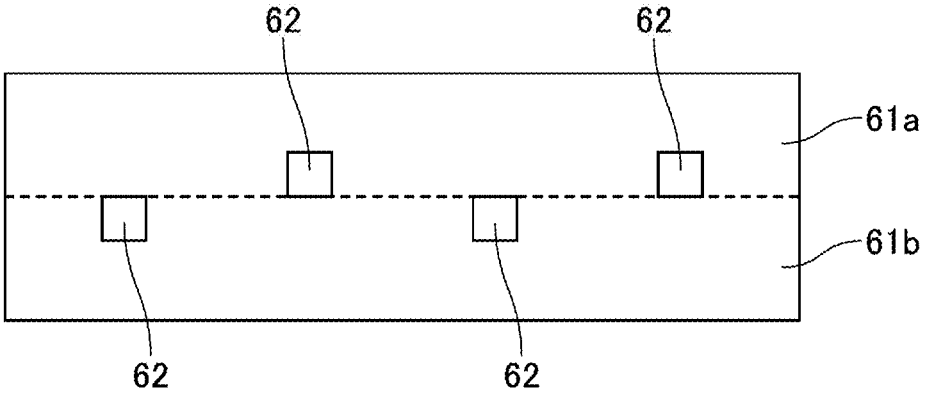
FIG. 4 is a top projection view of the hopper device as viewed from the line B-B illustrated in FIG. 1.

FIG. 1 is a front perspective view of a hopper device according to an embodiment of the present disclosure. FIG. 2 is a side perspective view of the hopper device illustrated in FIG. 1. FIG. 3 is a top projection view of the hopper device as viewed from the line A-A illustrated in FIG. 1. FIG. 4 is a top projection view of the hopper device as viewed from the line B-B illustrated in FIG. 1.

As illustrated in FIGS. 1 to 4, the present embodiment is described. The hopper device 1 includes a hopper body 10, a movable wire 20, and a scraping ball 50.

The hopper body 10 is provided with a discharge port 60 for discharging the sludge stored in the hopper body 10 on a lower surface of the hopper body 10. The discharge port 60 is provided with opening and closing gates 61*a* and 61*b*. The opening and closing gates 61*a* and 61*b* correspond to an example of an opening and closing portion in the present disclosure. The opening and closing gates 61*a* and 61*b* open and close the discharge port 60 by moving horizontally, for example. Further, for example, the discharge port 60 may be opened and closed by opening and closing the discharge port 60 in a double-door opening manner. Further, for example, the opening and closing gates 61*a* and 61*b* may have an arc shape in a cross-sectional view and may open and close the discharge port 60 by moving horizontally and vertically at the same time.

A support member 40 is provided in a region at a predetermined height above the discharge port 60 in the hopper body 10. The support member 40 is laid between the side walls of the hopper body 10 facing each other. In the present embodiment, four support members 40 are provided. The support member 40 may be a member filled with a material, such as a metal rod, or a member having a space therein, such as a pipe.

The movable wire 20 is an example of a wire member in the present disclosure. The movable wire 20 has a lower end connected to the opening and closing gates 61*a* and 61*b* at a lower joint 62 and an upper end connected to the support member 40 at an upper joint 41 via the spring 30. In the present embodiment, one movable wire 20 is connected to a corresponding support member 40 of the four support members 40. The lower ends of two of the four movable wires 20 are connected to the opening and closing gate 61*a*, and the lower ends of the remaining two movable wires 20 are connected to the opening and closing gate 61*b*. Thus, the four movable wires 20 are arranged such that two movable wires 20 cross each other when the hopper device 1 is viewed from the side.

The scraping ball 50 is an example of a compaction inhibiting member in the present disclosure. The scraping ball 50 is attached to the movable wire 20. In the present embodiment, four scraping balls 50 are attached to one movable wire 20 at equal intervals.

<Configuration of Scraping Ball>

Figure 5:
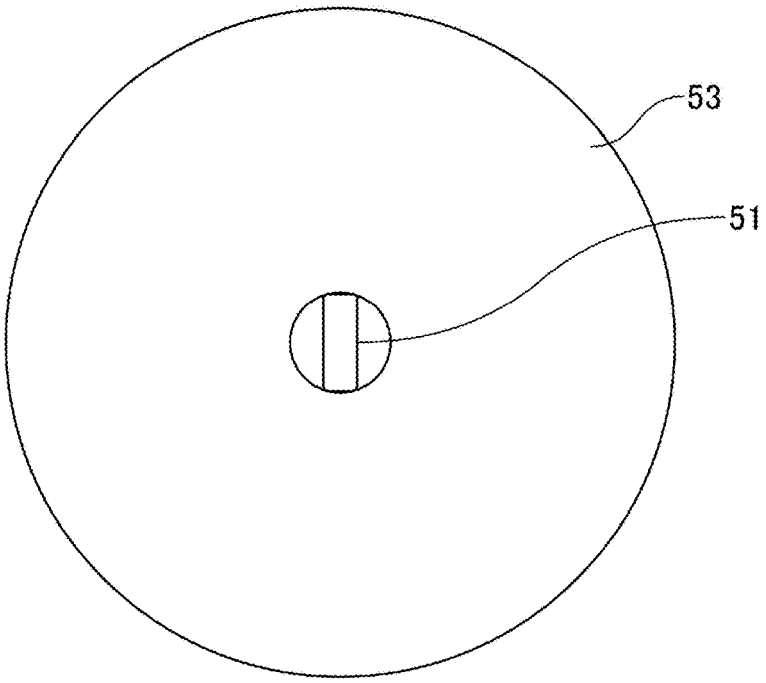
FIG. 5 is a top view of a scraping ball illustrated in FIG. 1.
Figure 6:
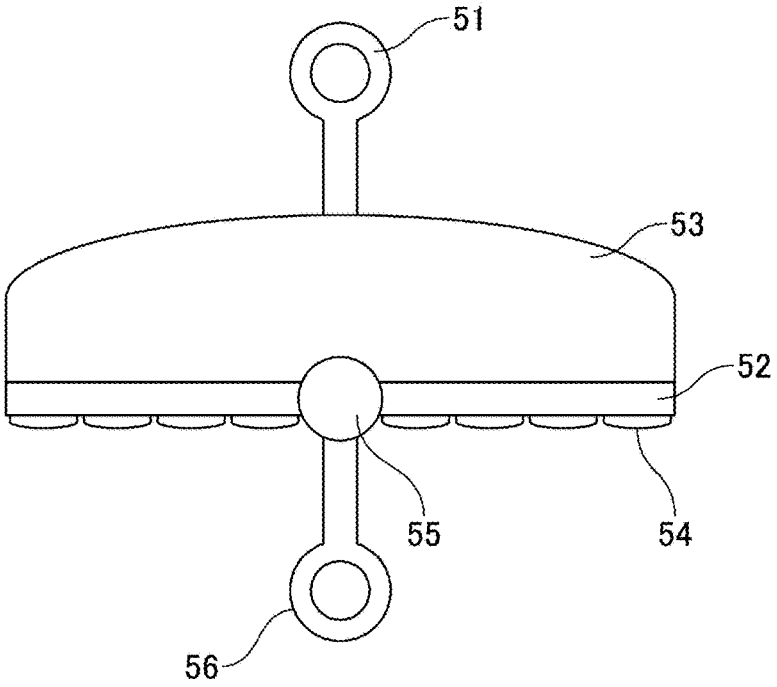
FIG. 6 is a side view of the scraping ball illustrated in FIG. 1.
Figure 7:
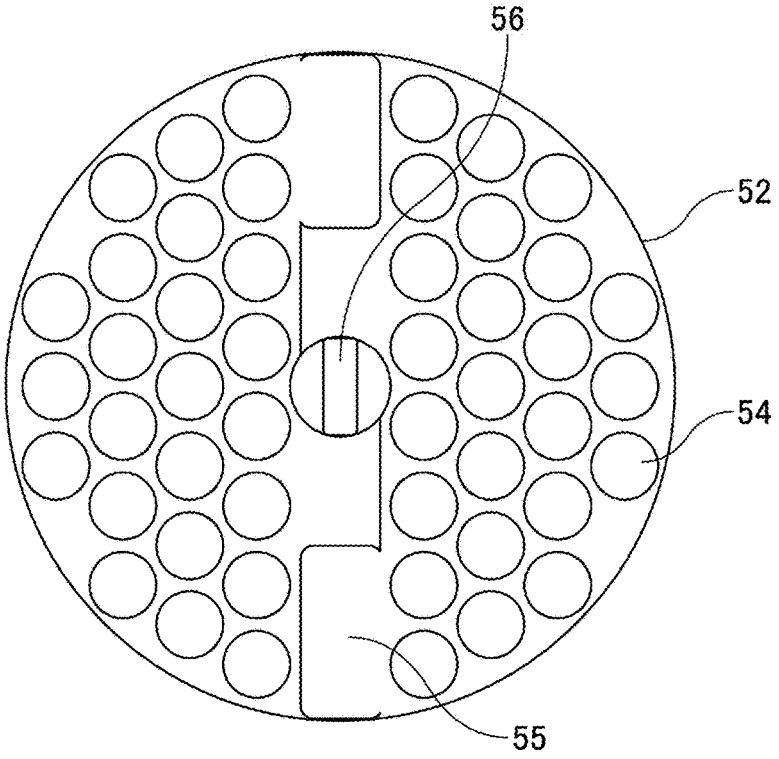
FIG. 7 is a bottom view of the scraping ball illustrated in FIG. 1.
Figure 8:
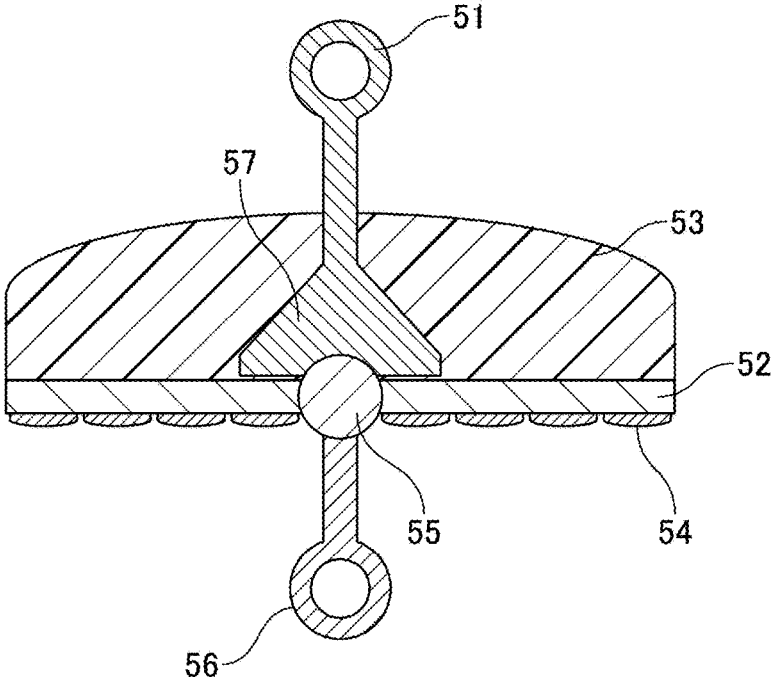
FIG. 8 is a cross-sectional view of the scraping ball illustrated in FIG. 1 in an opened state.
Figure 9:
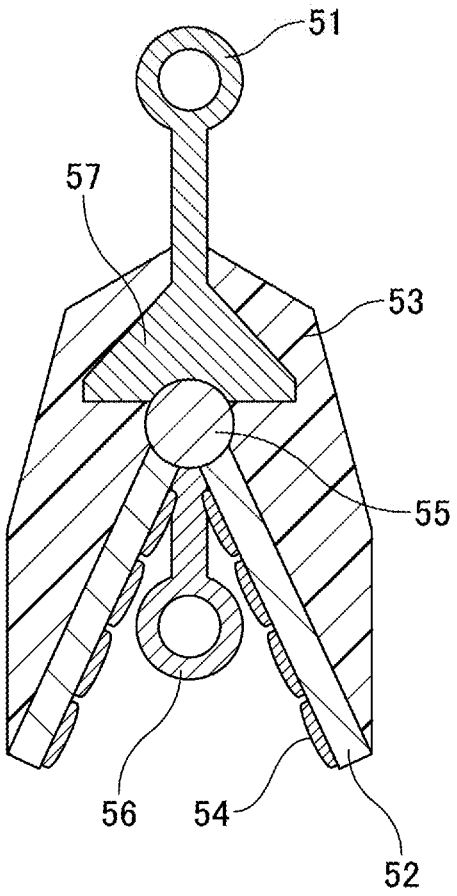
FIG. 9 is a cross-sectional view of the scraping ball illustrated in FIG. 1 in a closed state.

FIG. 5 is a top view of the scraping ball 50 illustrated in FIG. 1. FIG. 6 is a side view of the scraping ball 50 illustrated in FIG. 1. FIG. 7 is a bottom view of the scraping ball 50 illustrated in FIG. 1. FIG. 8 is a cross-sectional view of the scraping ball 50 illustrated in FIG. 1 in an opened state. FIG. 9 is a cross-sectional view of the scraping ball 50 illustrated in FIG. 1 in a closed state.

As illustrated in FIGS. 5 to 9, the scraping ball 50 illustrated in FIG. 1 includes an upper hanging metal fitting 51, a scraping plate 52, a resin cover 53, a scraping claw 54, a driving portion 55, and a lower hanging metal fitting 56.

The upper hanging metal fitting 51 is used to attach the scraping ball 50 to the movable wire 20, and is connected to the movable wire 20 at the upper portion of the scraping ball 50. For example, a ring-shaped attachment portion may be provided at the upper end of the upper hanging metal fitting 51, and the movable wire 20 may be connected to the attachment portion. The upper hanging metal fitting 51 is provided with a stopper 57 at its lower end. The stopper 57 is an example of a restricting member in the present disclosure. The stopper 57 is provided on the upper surface of the scraping plate 52 across two regions where the scraping plate 52 is folded. Thus, the stopper 57 can prevent the scraping plate 52 from closing upward from the disc-like opened state.

The lower hanging metal fitting 56 is used to attach the scraping ball 50 to the movable wire 20, and is connected to the movable wire 20 at the lower portion of the scraping ball 50. For example, a ring-shaped attachment portion may be provided at the lower end of the lower hanging metal fitting 56, and the movable wire 20 may be connected to the attachment portion.

The scraping plate 52 has a disc-like shape and is configured to be foldable such that the opened disc-like shape closes downward through a straight line passing through the center of the disk shape. The scraping plate 52 is configured such that, even when the scraping plate 52 is folded, the lower surface of the scraping plate 52 is in contact with the lower hanging metal fitting 56, and thus a gap is formed between the end portions facing each other.

The resin cover 53 is an example of a cover member in the present disclosure. The resin cover 53 is attached to the upper surface of the scraping plate 52 so as to cover the entire scraping plate 52. The resin cover 53 is made of an elastic member, and when the scraping plate 52 is folded, the surface of the resin cover 53 is curved so as to cover the entire scraping plate 52. Further, the resin cover 53 may be attached to the upper surface of the scraping plate 52 so as to cover the entire scraping plate 52, and thus the scraping plate 52 may be preloaded in an opening direction.

The scraping claw 54 is an example of a protrusion in the present disclosure. A plurality of scraping claws 54 are provided in a row on the lower surface of the scraping plate 52 so as to protrude below the scraping ball 50. Each scraping claw 54 may be a protrusion having a cylindrical shape, a conical shape, a polygonal pyramid shape including a triangular pyramid shape and a quadrangular pyramid shape, or a dome shape, for example.

The driving portion 55 is a portion serving as a shaft when the scraping plate 52 is folded from the opened disc-like shape to be closed downward.

<Operation of Hopper Device>

The operation of the hopper device 1 configured as described above will be described below.

Figure 10:
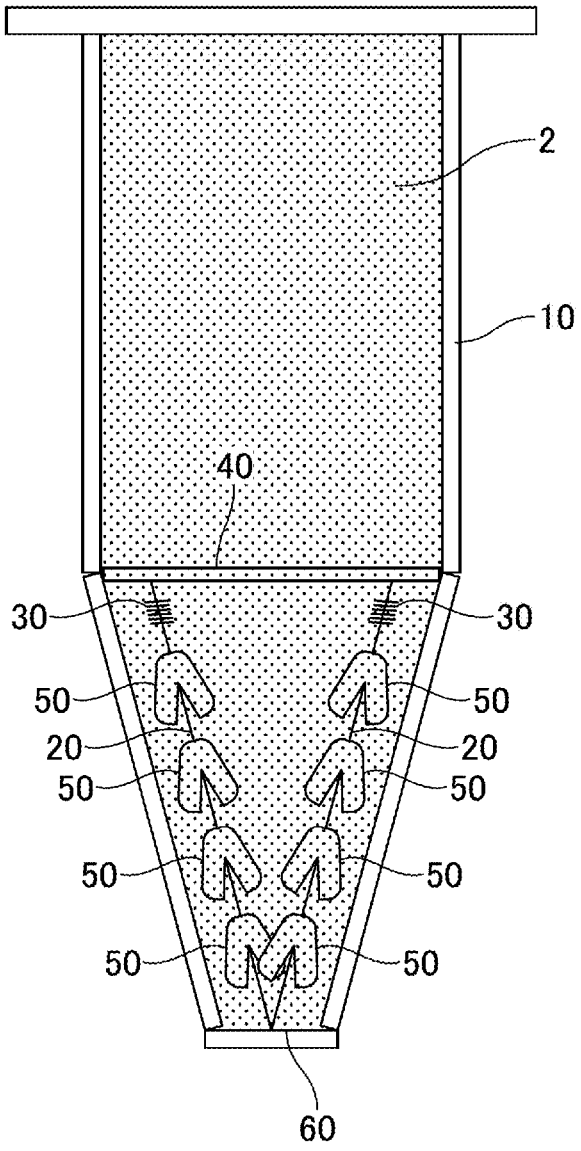
FIG. 10 is a view illustrating a state in which sludge is discharged from the hopper device illustrated in FIG. 1.
Figure 11:
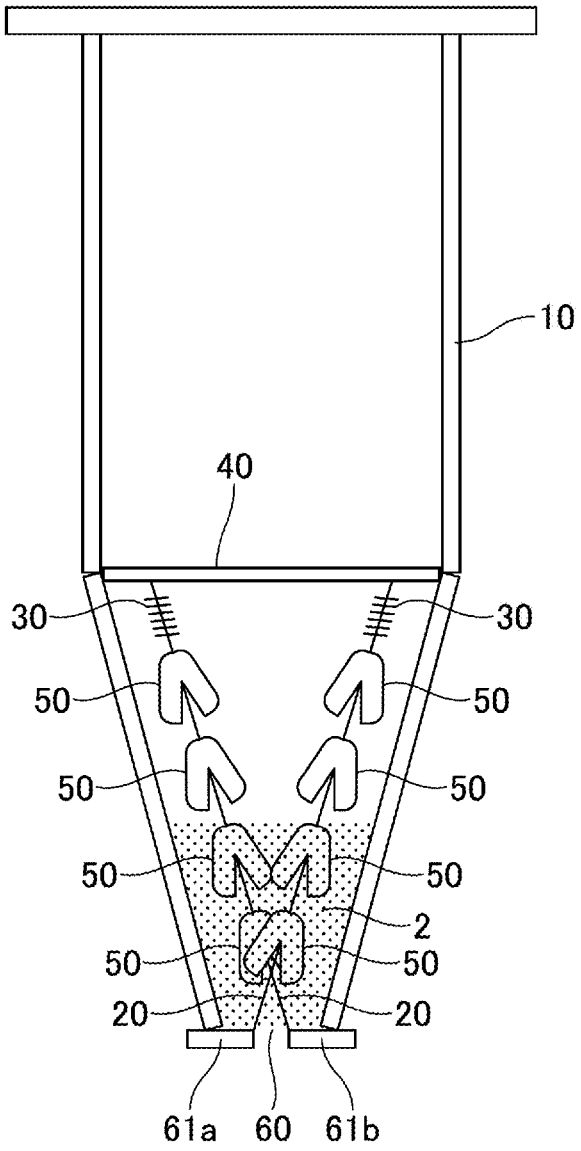
FIG. 11 is a view illustrating a state in which sludge is discharged from the hopper device illustrated in FIG. 1.
Figure 12:
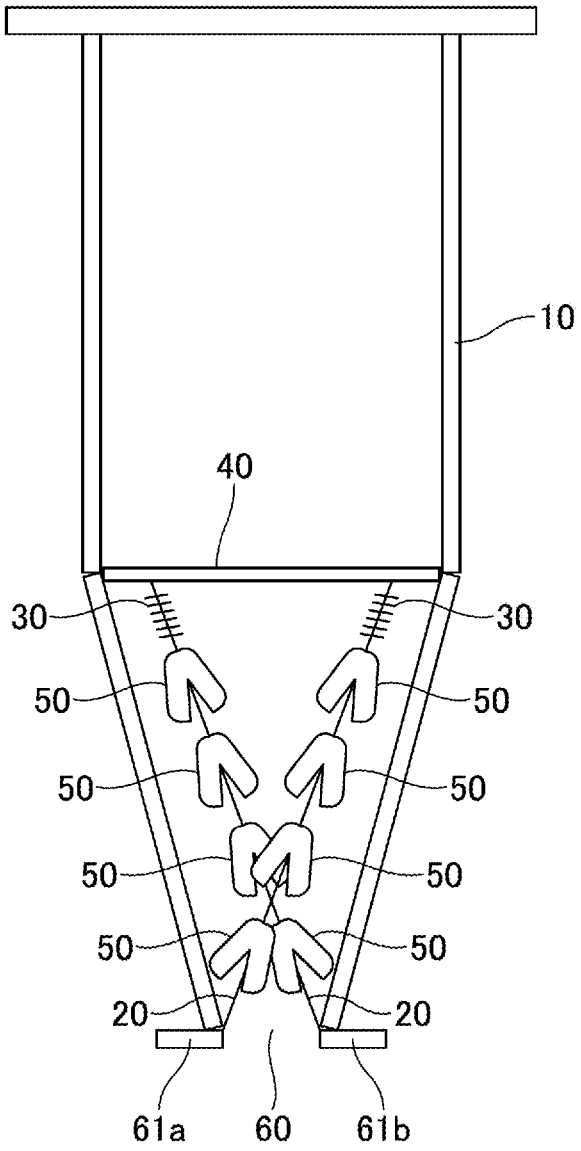
FIG. 12 is a view illustrating a state in which sludge is discharged from the hopper device illustrated in FIG. 1.

FIGS. 10 to 12 are views illustrating a state in which sludge is discharged from the hopper device 1 illustrated in FIG. 1. Note that, in FIGS. 10 to 12, the scraping plate of each scraping ball 50 is folded so as to be closed downward, but an actual state of the scraping ball 50 will be described below. Further, FIGS. 13 to 16 are views illustrating a state of the scraping ball 50 when the sludge is discharged from the hopper device 1 illustrated in FIG. 1.

Figure 13:
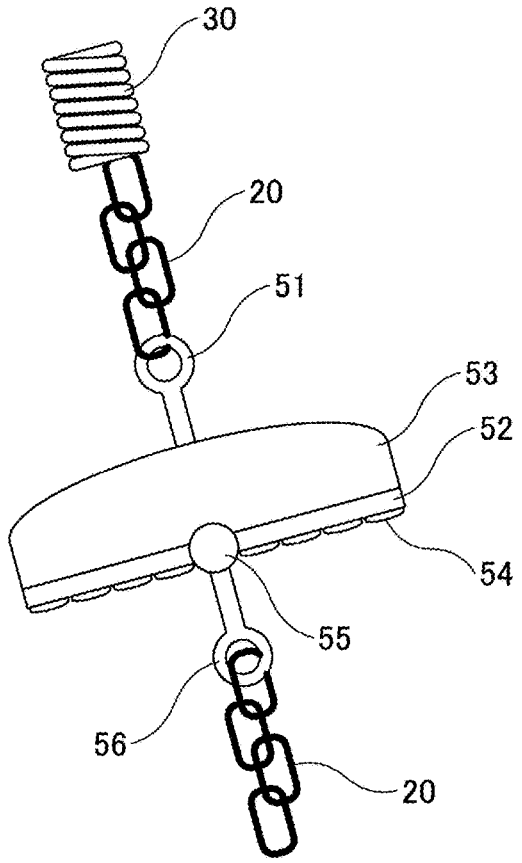
FIG. 13 is a view illustrating a state of a scraping ball when sludge is discharged from the hopper device illustrated in FIG. 1.

In the hopper device 1 configured as described above, in a state where the sludge is not stored in the hopper body 10, the scraping plate 52 has an opened disc-like shape as illustrated in FIG. 13. At this point, when the scraping plate 52 is preloaded by the resin cover 53 in the opening direction, the opened disc-like shape of the scraping plate 52 is maintained.

When the sludge as the stored material is stored in the hopper body 10 from this state, the sludge is deposited on the resin cover 53 of the scraping plate 52 due to the scraping plate 52 being in the opened disc-like shape, and the scraping plate 52 is folded downward by the weight of the sludge. When the scraping plate 52 is folded, the surface of the resin cover 53 is curved. Therefore, the sludge is likely to fall downward.

Figure 14:
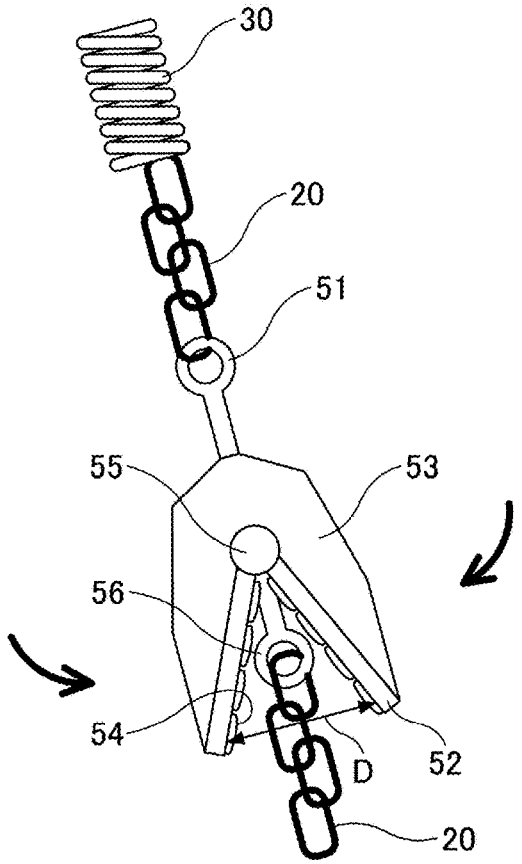
FIG. 14 is a view illustrating a state of the scraping ball when sludge is discharged from the hopper device illustrated in FIG. 1.

Thus, in the state where the sludge 2 has completely filled the hopper body 10 as illustrated in FIG. 10, the scraping plate 52 is folded downward as illustrated in FIG. 14. At this point, even when the scraping plate 52 is folded, the lower surface of the scraping plate 52 is in contact with the lower hanging metal fitting 56, and thus a gap D is formed between the end portions of the scraping plate 52 facing each other. Thus, even when the scraping plate 52 is folded, compaction by the sludge 2 is inhibited mainly below each scraping ball 50. In this case, the sludge 2 as a stored material is stored in the hopper body 10, and thus the movable wire 20 may bend.

Figure 15:
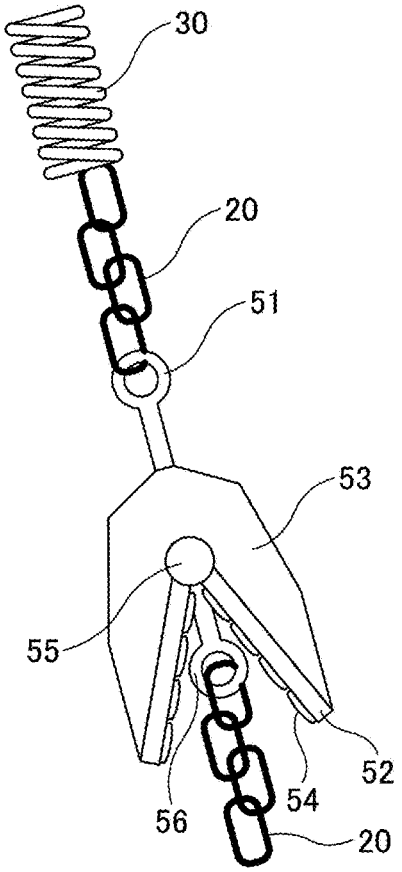
FIG. 15 is a view illustrating a state of the scraping ball when sludge is discharged from the hopper device illustrated in FIG. 1.

Thereafter, when the opening and closing gates 61*a* and 61*b* are opened to discharge the sludge 2 stored in the hopper body 10 from the discharge port 60, the sludge 2 stored in the hopper body 10 is discharged from the discharge port 60 as illustrated in FIG. 11. Further, for each of the movable wires 20 connected to the opening and closing gates 61*a* and 61*b*, the movable wire 20 is pulled downward and moved downward. At this point, as illustrated in FIG. 15, the movable wire 20 is pulled downward, and the spring 30 is extended. According to this configuration, the scraping ball 50 attached to the movable wire 20 also moves downward. The movable wire 20 may also move slightly in the horizontal direction.

Although the opening and closing gates 61*a* and 61*b* are horizontally moved as illustrated as an example in the above description, the movement of the opening and closing gates 61*a* and 61*b* is not limited to this example. The opening and closing gates 61*a* and 61*b* may be opened and closed in a double-door opening manner such that the opening and closing gates 61*a* and 61*b* are opened or closed downward at the center of the opening and closing gates 61*a*, or the opening and closing gates 61*a* and 61*b* may be formed in an arc shape in a cross-sectional view and horizontally and vertically moved in combination. Since the movable wire 20 is connected to the opening and closing gates 61*a* and 61*b*, the movable wire 20 can be pulled downward by increasing the amount of vertical movement in connected portions of the opening and closing gates 61*a* and 61*b* to which the movable wire 20 is connected, and thus the scraping balls 50 can be moved downward.

At this point, each scraping ball 50 does not prevent the falling of the sludge 2 because the scraping plate 52 is not in a disc-like shape but in a downwardly closed state, and thus the sludge 2 easily moves downward. Further, when the sludge 2 is stored, the scraping balls 50 maintain the disc-like shape for a certain period of time against the falling of the sludge 2 to prevent the sludge 2 from being easily stored below the scraping ball 50, and thus the compaction state is alleviated as compared with a state in which the scraping balls 50 are not provided. Thus, the sludge 2 is prevented from being compacted in the hopper body 10, and the sludge 2 is easily discharged from the discharge port 60.

A plurality of scraping claws 54 are provided on the lower surface of the scraping plate 52 so as to protrude downward from the scraping ball 50. Therefore, the scraping of the sludge 2 by the scraping plate 52 can be promoted, and the sludge 2 is less likely to adhere to the lower surface of the scraping plate 52.

Figure 16:
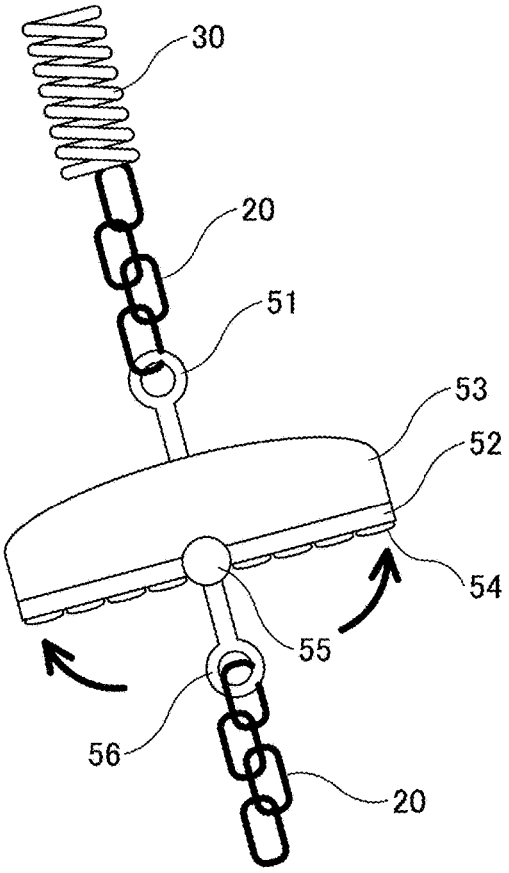
FIG. 16 is a view illustrating a state of the scraping ball when sludge is discharged from the hopper device illustrated in FIG. 1.

Thereafter, when all the sludge 2 stored in the hopper body 10 is discharged as illustrated in FIG. 12, the scraping plate 52 returns to the opened disc-like shape as illustrated in FIG. 16. This is based on the fact that the resin cover 53 is made of an elastic member. As described above, since the scraping plate 52 is preloaded in the opening direction by the resin cover 53, the scraping plate 52 operates to return to the opened disc-like shape in response to the discharge of the sludge 2 deposited on the resin cover 53.

As described above, the stopper 57 is provided on the upper surface of the scraping plate 52 across the two regions where the scraping plate 52 is folded. Thus, when the scraping plate 52 returns to the opened disc-like shape, the scraping plate 52 can be prevented from being warped upward from the opened disc-like shape by the stopper 57. The scraping plate 52 returns to the state before the sludge 2 is stored, such that the effect of inhibiting the compaction of the sludge to be stored next can be maintained and the sludge can be used repeatedly.

Second Embodiment

As a hopper device according to a second embodiment of the present disclosure, a lock mechanism configured to lock a state of the scraping plate 52 may be provided. The lock mechanism is an example of a holding unit in the present disclosure.

<Configuration of Lock Mechanism>

Figure 17:
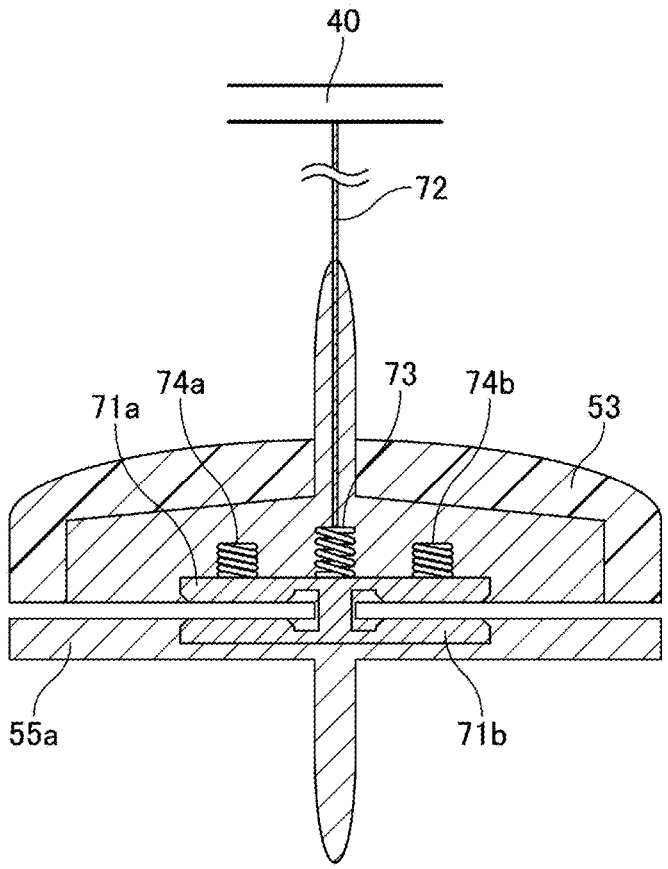
FIG. 17 is a view illustrating an example of a lock mechanism configured to lock a state of a scraping plate.
Figure 18:
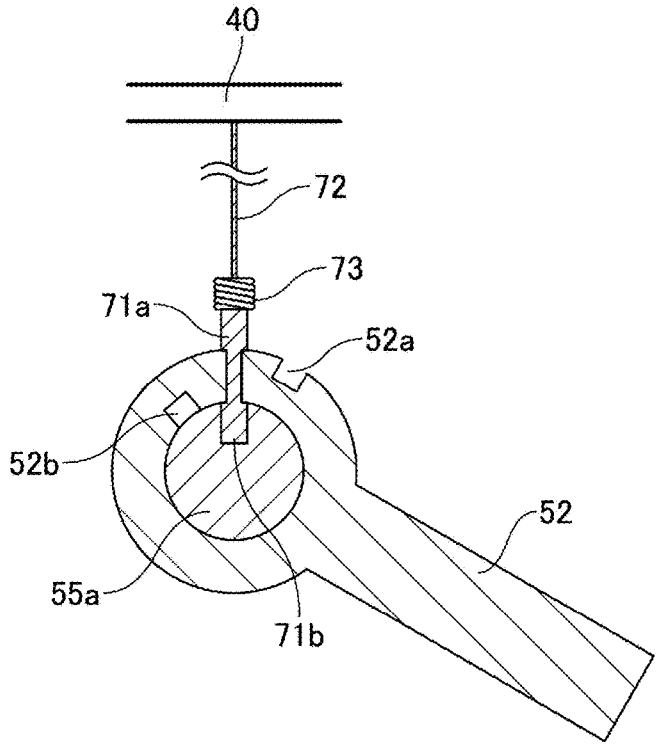
FIG. 18 is a view illustrating an example of the lock mechanism configured to lock a state of the scraping plate.
Figure 19:
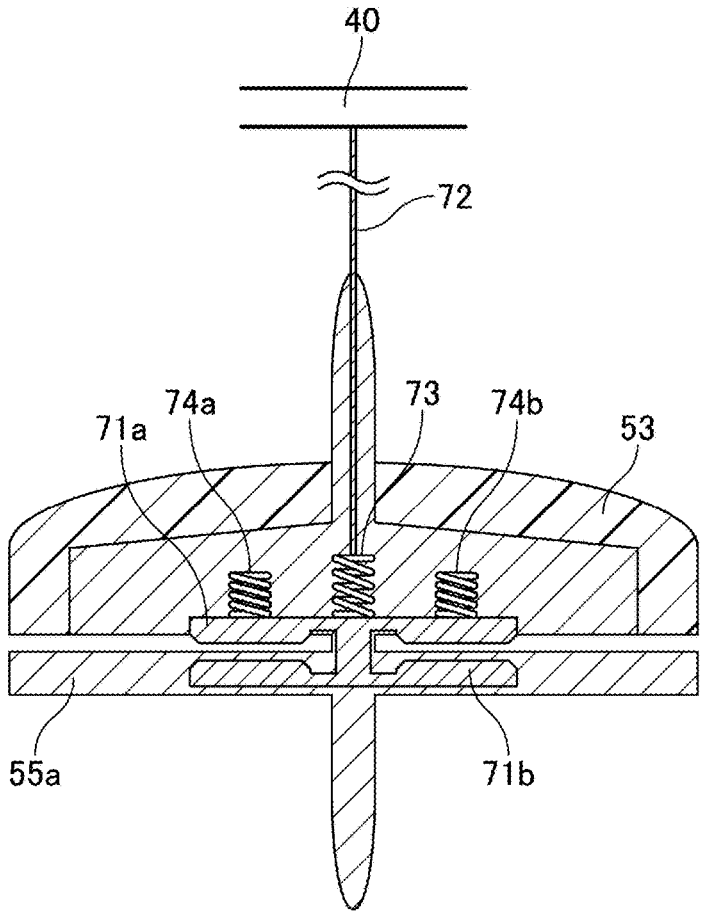
FIG. 19 is a view illustrating an example of the lock mechanism configured to lock a state of the scraping plate.
Figure 20:
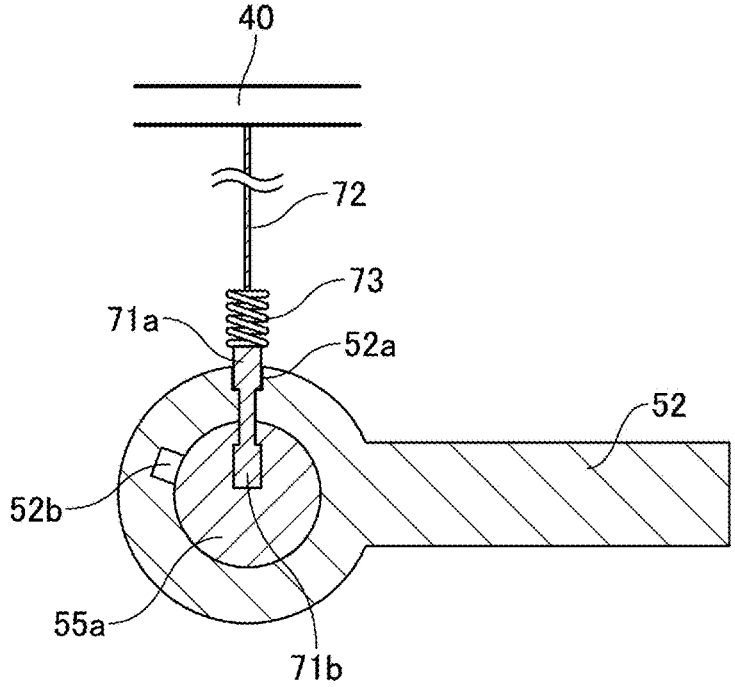
FIG. 20 is a view illustrating an example of the lock mechanism configured to lock the state of the scraping plate.
Figure 21:
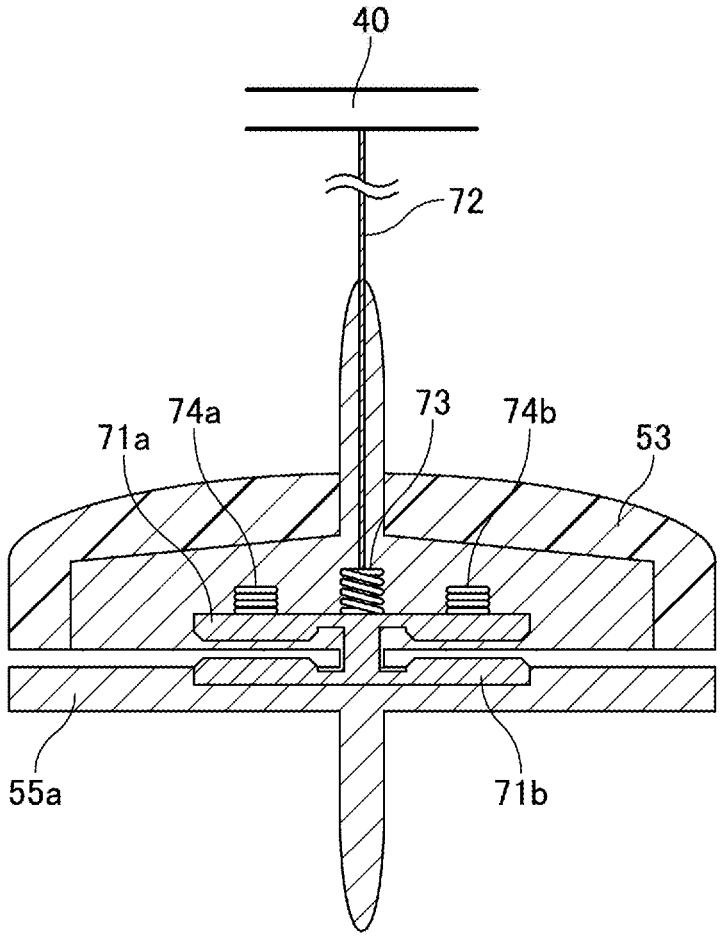
FIG. 21 is a view illustrating an example of the lock mechanism configured to lock a state of the scraping plate.
Figure 22:
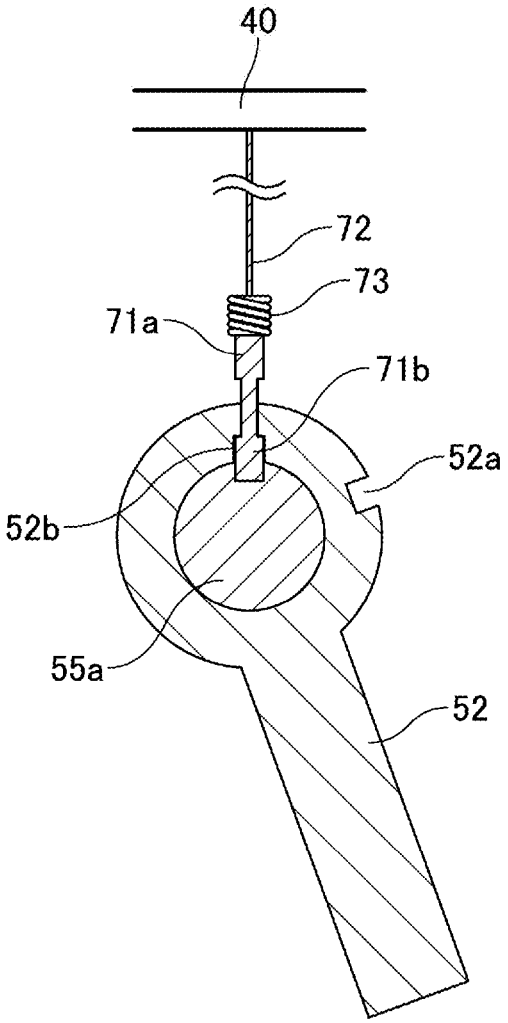
FIG. 22 is a view illustrating an example of the lock mechanism configured to lock a state of the scraping plate.

FIGS. 17 to 22 are views illustrating an example of a lock mechanism configured to lock the state of the scraping plate 52. FIG. 17 is a cross-sectional view in the axial direction of the driving portion 55 in a state where the state of the scraping plate 52 is not locked, and FIG. 18 is a cross-sectional view in a direction orthogonal to the direction illustrated in FIG. 17 in a state where the state of the scraping plate 52 is not locked. FIG. 19 is a cross-sectional view in the axial direction of the driving portion 55 in a state where the scraping plate 52 is locked in an opened state, and FIG. 20 is a cross-sectional view in a direction orthogonal to the direction illustrated in FIG. 19 in a state where the scraping plate 52 is locked in an opened state. FIG. 21 is a cross-sectional view in the axial direction of the driving portion 55 in a state where the scraping plate 52 is locked in a closed state, and FIG. 22 is a cross-sectional view in a direction orthogonal to the direction illustrated in FIG. 21 in a state where the scraping plate 52 is locked in a closed state. In FIGS. 17, 19, and 21, the scraping plate 52 is not illustrated. In FIGS. 18, 20, and 22, only one of the regions of the scraping plate 52 which is opened and closed by the driving portion 55 is illustrated.

As the lock mechanism configured to lock the state of the scraping plate 52, as illustrated in FIGS. 17 to 22, a lock mechanism including lock claws 71*a* and 71*b*, a lock cable 72, a spring 73, and springs 74*a* and 74*b* may be used. Lock grooves 52*a* and 52*b* serving as recess portions are provided around the drive shaft of the driving portion 55 of the scraping plate 52. A shaft 55*a* as the drive shaft is illustrated so as to include the lock claw 71*b*. However, in practice, since the lock claw 71*b* is movable up and down, a space in which the lock claw 71*b* can be moved is provided in the shaft 55*a*. It should be noted that although not illustrated in the actual cross section, the shaft 55*a* is arranged in a depth direction in the drawings for the sake of explanation and understanding. As an example, one end of the lock cable 72 is connected to the support member 40 as a fixed end. However, the connection destination of the lock cable 72 is not limited to the support member 40. For example, the lock cable 72 may be connected to a mechanism that pulls the lock cable 72 upward and returns the lock cable 72 downward in conjunction with the opening and closing operation of the opening and closing gates 61*a* and 61*b*. Although the state in which the scraping balls 50 are connected in series is omitted from the drawings, the lock cable 72 may be configured to run through the upper scraping ball 50 and connect the upper scraping ball 50 to the lower scraping ball 50 so as to operate in a similar manner, for example.

The lock groove 52*a* has a shape in which the lock claw 71*a* serving as a claw portion can be inserted and removed, and is provided at a position facing the lock claw 71*a* when the lock cable 72 is operated in a state where the scraping plate 52 is opened. The lock groove 52*b* has a shape that allows the lock claw 71*b* serving as a claw portion to be inserted and removed, and is provided at a position facing the lock claw 71*b* when the lock cable 72 is operated in a state where the scraping plate 52 is closed.

The spring 73 is made of a material harder than the springs 74*a* and 74*b*, and the springs 73, 74*a*, and 74*b* are arranged side by side such that the spring 73 is located between the springs 74*a* and 74*b*. The hardness of the spring 73 is an example, and the spring 73 may have any hardness insofar as the lock mechanism is not lost even when the lock cable 72 is pulled downward by the falling sludge 2 to be stretched or bend. In this case, the hardness of the spring 73 may be set to a degree such that the retention of the lock mechanism is not lost even when the movable wire 20 moves in the vertical direction or the horizontal direction together with the scraping ball 50 due to the accumulation or the falling of the sludge 2 or even when the movable wire 20 is swung. As another example, the spring 73 may have such a hardness that when the scraping ball 50 moves downward together with the movable wire 20 due to the falling or storage of the sludge 2, the spring 73 absorbs the forces applied to the lock cable 72 and maintains the fully extended state beyond the forces applied to the springs 74*a* and 74*b* at the time when predetermined forces are applied, thereby releasing the holding of the lock mechanism. As still another example, the hardness may be such that the holding of the lock mechanism is released when the scraping ball 50 moves downward together with the movable wire 20 by the operation of the opening and closing gates 61*a* and 61*b*. In the following, an example will be described in which the lock mechanism is held and released by the operation of the opening and closing gates 61*a* and 61*b* while the state of the scraping plate 52 changes depending on the state of the storage of the sludge 2 and the forces applied to the resin cover 53 by the elastic members even if the movable wire 20 moves in the vertical direction or the horizontal direction or swings together with the scraping ball 50 due to the falling or storage of the sludge 2. The timing of releasing the holding of the lock mechanism is not limited to the example described below.

Although the above-described lock mechanism has been exemplified as a mechanism for holding the scraping plate 52 in two states, that is, a state in which the scraping plate 52 is opened and a state in which the scraping plate 52 is closed, when only one state is desired to be held, a part of the lock mechanism corresponding to one state can be used as appropriate. The operation of the scraping ball 50 described below will be described with an example in which one state of the scraping plate 52 is held, that is, the scraping plate 52 in a closed state is held and released. That is, the lock groove 52*a* is not provided in the example. In the following, an example will be described in which the state in which the scraping plate 52 is closed is maintained when the opening and closing gates 61*a* and 61*b* are opened, and the state in which the scraping plate 52 is closed is released when the opening and closing gates 61*a* and 61*b* are closed.

<Operation of Hopper Device 1 in Case of Being Provided With Lock Mechanism>

When the hopper device 1 illustrated in FIG. 1 is provided with the above-described lock mechanism, the scraping plate 52 is not in the locked state and has an opened disc-like shape as illustrated in FIG. 13 in a state where no sludge is stored in the hopper body 10.

When the sludge as the stored material is stored in the hopper body 10 from this state, the sludge is deposited on the resin cover 53 of the scraping plate 52 due to the scraping plate 52 having an opened disc-like shape. Since the scraping plate 52 is not in the locked state, the scraping plate 52 is folded downward by the weight of the sludge. When the scraping plate 52 is folded, the surface of the resin cover 53 is curved. Therefore, the sludge is likely to fall downward.

Thus, in the state where the sludge 2 has been completely filled in the hopper body 10 as illustrated in FIG. 10, the scraping plate 52 is folded downward as illustrated in FIG. 14. At this point, even when the scraping plate 52 is folded, the lower surface of the scraping plate 52 is in contact with the lower hanging metal fitting 56, and thus a gap D is formed between the end portions of the scraping plate 52 facing each other. This configuration inhibits compaction mainly below the scraping ball 50 even when the scraping plate 52 is folded. In this case, the movable wire 20 may bend as the sludge as the stored material is stored in the hopper body 10.

Thereafter, when the opening and closing gates 61*a* and 61*b* are opened to discharge the sludge 2 stored in the hopper body 10 from the discharge port 60, the sludge 2 stored in the hopper body 10 is discharged from the discharge port 60 as illustrated in FIG. 11. Further, the movable wire 20 connected to the opening and closing gates 61*a* and 61*b* is pulled downward and moved downward. At this point, as illustrated in FIG. 15, the movable wire 20 is pulled downward, and the spring 30 is extended. According to this configuration, the scraping balls 50 attached to the movable wire 20 also move downward. The movable wire 20 may also move slightly in the horizontal direction.

At this point, each scraping ball 50 does not prevent the falling of the sludge 2 because the scraping plate 52 is not in a disc-like shape but in a downwardly closed state, and thus the sludge 2 easily moves downward. Further, when the sludge 2 is stored, the scraping balls 50 maintain the disc-like shape for a certain period of time against the falling of the sludge 2 to prevent the sludge 2 from being easily stored below the scraping ball 50, and thus, the compaction state is alleviated as compared with the state where the scraping balls 50 are not provided. Thus, the sludge 2 is prevented from being compacted in the hopper body 10, and the sludge 2 is easily discharged from the discharge port 60.

Here, since the resin cover 53 is made of an elastic member, the scraping plate 52 may return to the opened disc-like shape when the scraping ball 50 moves downward, depending on the amount and weight of the sludge 2. In this embodiment, therefore, the scraping plate 52 is locked in the closed state in conjunction with the opening of the opening and closing gates 61*a* and 61*b*. This may be performed by utilizing the downward pulling force of the lock cable 72 caused by the scraping ball 50 moving downward when the opening and closing gates 61*a* and 61*b* are opened. When the spring 73 of the lock mechanism maintains the extended state by the pulling force of the lock cable 72 exceeding the preloading force of the springs 74*a* and 74*b*, the lock claw 71*b* is inserted into the lock groove 52*b*. While the opening and closing gates 61*a* and 61*b* are opened and the lock cable 72 is pulled at least downward, as illustrated in FIGS. 21 and 22, the lock claw 71*b* is inserted into the lock groove 52*b*, and the scraping plate 52 is locked in a closed state.

This configuration prevents the scraping plate 52 from returning to the opened disc-like shape when the scraping ball 50 moves downward. That is, while the scraping ball 50 opens the opening and closing gates 61*a* and 61*b* to discharge the sludge 2, the scraping plate 52 is kept closed, and the discharge of the sludge 2 is not inhibited, and the discharge of the sludge 2 can be promoted.

Thereafter, as illustrated in FIG. 12, when the opening and closing gates 61*a* and 61*b* are closed again after the sludge 2 stored in the hopper body 10 is all discharged, the movable wire 20 is moved upward together with the scraping ball 50 from the downward position, such that the downward pulling force of the lock cable 72 is released, the expanding force of the spring 73 is alleviated, the lock claw 71*b* is pushed downward by the preloading force of the springs 74*a* and 74*b*, the lock claw 71*b* is pulled out of the lock groove 52*b*, and the scraping plate 52 is unlocked. Such operation causes the scraping plate 52 to return to its opened disc-like shape, as illustrated in FIG. 16. This is based on the fact that the resin cover 53 is made of an elastic member. As described above, since the scraping plate 52 is preloaded in the opening direction by the resin cover 53, the scraping plate 52 operates to return to the opened disc-like shape in response to the discharge of the sludge 2 deposited on the resin cover 53. That is, by not using the lock groove 52*a* and the lock claw 71*a* of the lock mechanism, the same operation can be repeated when the sludge is stored again after the shape of the disk is restored. As described above, the scraping plate 52 is unlocked by operating the lock cable 72, including the indirect mechanical action caused by the movement of the scraping ball 50.

The operation of the scraping ball 50 has been described above by way of example as holding one state, i.e., holding the scraping plate 52 in the closed state, and releasing the scraping plate 52 held in the closed state. However, as described above, the lock claw 71*a* and the lock groove 52*a* may be provided to hold the two states. In this case, the force preloaded by the hardness of the springs 73, 74*a* and 74*b*, the flexure of the lock cable 72, the shape and opening and closing direction of the opening and closing gates 61*a* and 61*b*, the position at which the movable wire 20 is connected to the opening and closing gates 61*a* and 61*b*, and the like may be appropriately adjusted. For example, when the opening and closing gates 61*a* and 61*b* are opened, the movable wire 20 moves downward to generate a force for pulling the lock cable 72 downward, and at the same time, the lock claw 71*a* is pulled out from the lock groove 52*a* to unlock the lock mechanism, and when the opening and closing gates 61*a* and 61*b* are fully opened, the lock claw 71*b* is inserted into the lock groove 52*b* to hold the lock state by the lock mechanism, and the lock claw 71*a* is inserted into the lock groove 52*a* again to hold the lock state by the lock mechanism in the state where the opening and closing gates 61*a* and 61*b* are fully closed again.

Further, the timing of holding the lock mechanism when the opening and closing gates 61*a* and 61*b* are fully opened or fully closed is not limited to the above-described example. The timing can be changed by adjusting the conditions as appropriate.

Further, the lock cable 72 connected to the support member 40 as the fixed end has been exemplified above, but the present disclosure is not limited thereto. For example, a mechanism for pulling or returning the lock cable 72 at an appropriate timing in conjunction with the operation of the opening and closing gates 61*a* and 61*b* may be combined. Further, the lock mechanism can be held and released partway through the opening and closing operation of the opening and closing gates 61*a* and 61*b*, for example, by adjusting the hardness of the springs 73, 74*a* and 74*b*, the flexure of the lock cable 72, the shape, and the opening and closing directions of the opening and closing gates 61*a* and 61*b*, the position at which the movable wire 20 is connected to the opening and closing gates 61*a* and 61*b*, and the like.

Further, although the description has been made that the holding and releasing of the lock mechanism are performed by the opening and closing operation of the opening and closing gates 61*a* and 61*b* as a trigger, for example, the holding and releasing may be performed at a timing when the scraping ball 50 moves downward partially according to the storage state of the sludge 2. As an example, the lock mechanism may be configured to release the holding when the scraping ball 50 moves downward to a predetermined position after the amount of the sludge 2 stored reaches a predetermined amount.

Hereinafter, in other embodiments, the lock mechanism necessary for the operation is applied to the above-described examples or a combination of the examples as appropriate. In addition, the above-described examples can be applied or combined and applied even to operations other than the necessary operations of the lock mechanism described in the other embodiments.

Third Embodiment

The scraping ball may be a scraping ball in which a metal cover made of a metal layer is attached to the upper surface of the scraping plate.

FIGS. 23 to 26 are views illustrating a state of a scraping ball 150 when the sludge is discharged in the case where the scraping ball having a metal cover attached to the upper surface of the scraping plate is used in the hopper device 1 illustrated in FIG. 1.

As illustrated in FIGS. 23 to 26, the scraping ball 150 in which a metal cover 153 is attached to an upper surface of a scraping plate 52 may be used. In this case, the metal cover 153 may be divided into two parts with a driving portion 55 interposed therebetween, and an elastic resin 159 may be provided above the driving portion 55 between the two parts of the metal cover 153. By adopting the configuration in which the metal cover 153 is attached to the upper surface of the scraping plate 52, the strength of the upper surface is secured, the effect of controlling the sludge is enhanced, and the durability of the scraping ball 150 can be improved, as compared with the configuration in which the resin cover 53 is attached to the upper surface of the scraping plate 52.

Figure 23:
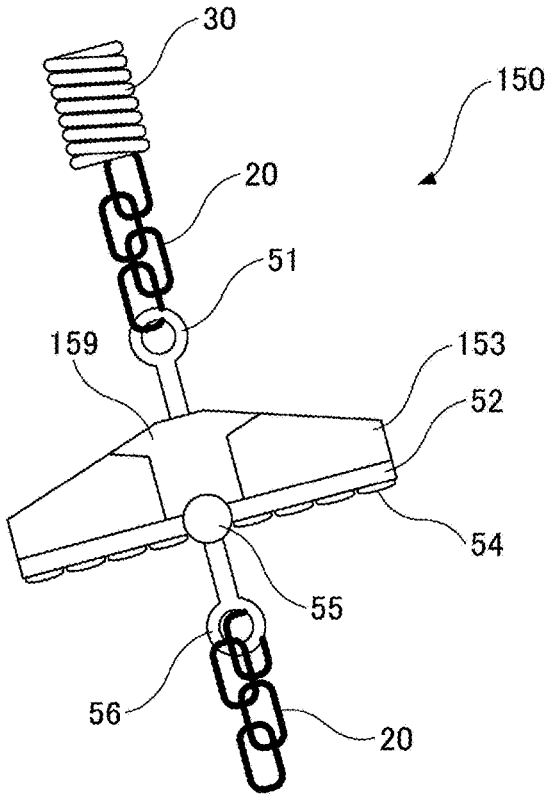
FIG. 23 is a view illustrating a state of the scraping ball when sludge is discharged in the hopper device illustrated in FIG. 1, in the case where the scraping ball having a metal cover attached to an upper surface of the scraping plate is used.

In such a configuration, when no sludge is stored in the hopper body 10, the scraping plate 52 is in the opened disc-like shape as illustrated in FIG. 23. At this point, the scraping plate 52 may be locked in the opened state by the above-described lock mechanism. In this case, as illustrated in FIGS. 19 and 20, the lock claw 71*a* is inserted into the lock groove 52*a* by operating the lock cable 72, and the scraping plate 52 is locked in an opened state. Although such re-description may be unnecessary, the lock claw 71*a* and lock groove 52*a* do not need to be provided insofar as the disk-like shape of the scraping plate 52 can be maintained by the force preloaded by the elastic resin 159 even when the scraping plate 52 is not locked in the opened state.

Figure 24:
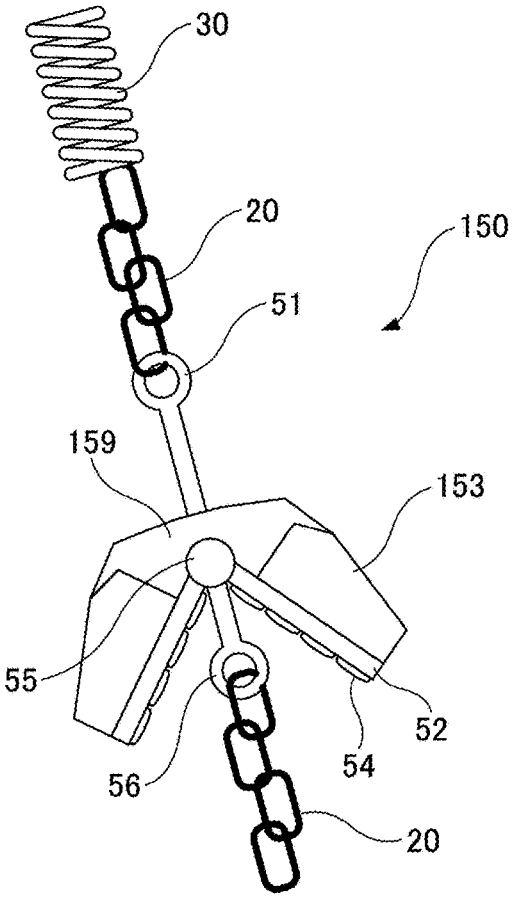
FIG. 24 is a view illustrating a state of the scraping ball when sludge is discharged in the hopper device illustrated in FIG. 1, in the case where the scraping ball having the metal cover attached to the upper surface of the scraping plate is used.

From this state, first, the lock cable 72 is operated by using the operation of the above-described lock mechanism, and as illustrated in FIGS. 17 and 18, the lock claw 71*a* is pulled out from the lock groove 52*a*, and the scraping plate 52 is unlocked. When the sludge as the stored material is stored in the hopper body 10, the sludge is deposited on the metal cover 153 of the scraping plate 52 due to the scraping plate 52 being in the opened disc-like shape, and the scraping plate 52 is folded downward by the weight of the sludge as illustrated in FIG. 24. At this point, the metal cover 153 and the elastic resin 159 are inclined such that the height of the surface of the scraping plate 52 decreases from the center portion toward the end portion to form an umbrella shape, and thus the sludge deposited on the metal cover 153 easily falls.

Thereafter, when the opening and closing gates 61*a* and 61*b* are opened to discharge the sludge 2 stored in the hopper body 10 from the discharge port 60, the sludge 2 stored in the hopper body 10 is discharged from the discharge port 60. Further, the movable wire 20 is pulled downward and moved downward, and thus the scraping balls 150 attached to the movable wire 20 are also moved downward.

Figure 25:
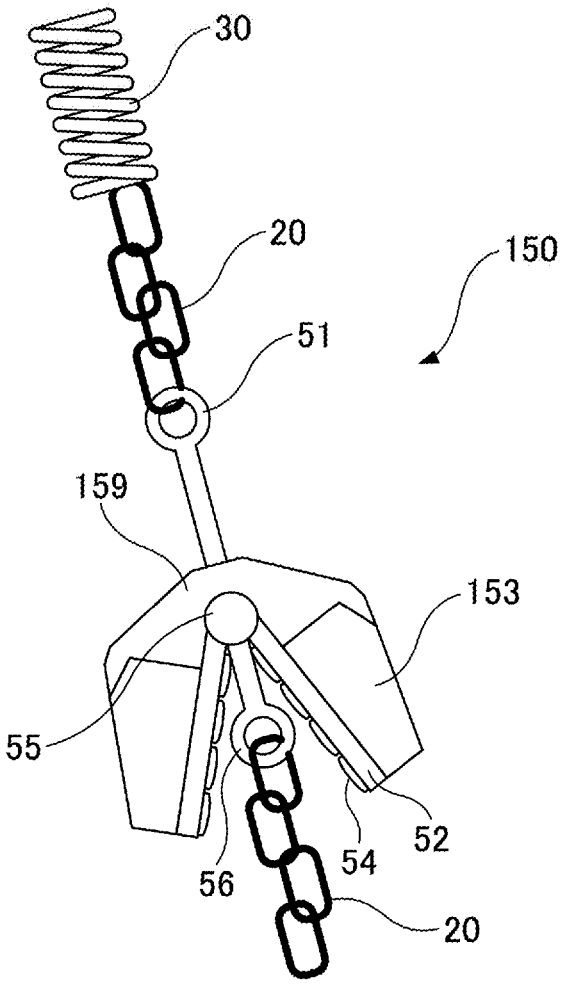
FIG. 25 is a view illustrating a state of the scraping ball when sludge is discharged in the hopper device illustrated in FIG. 1, in the case where the scraping ball having the metal cover attached to the upper surface of the scraping plate is used.

At this point, each scraping ball 150 does not prevent the falling of the sludge 2 because the scraping plate 52 is not in a disc-like shape but in a downwardly closed state, and thus the sludge 2 easily moves downward. Further, when the sludge 2 is stored, the scraping balls 150 maintain the disc-like shape for a certain period of time against the falling of the sludge 2 to prevent the sludge 2 from being easily stored below the scraping ball 150, and thus, the compaction state is alleviated as compared with the state where the scraping balls 150 are not provided. Thus, the sludge 2 is prevented from being compacted in the hopper body 10, and the sludge 2 is easily discharged from the discharge port 60. In this case, the scraping plate 52 may be locked in the closed state as illustrated in FIG. 25. Thus, when the scraping ball 150 moves downward, the scraping plate 52 does not return to the opened disc-like shape.

Figure 26:
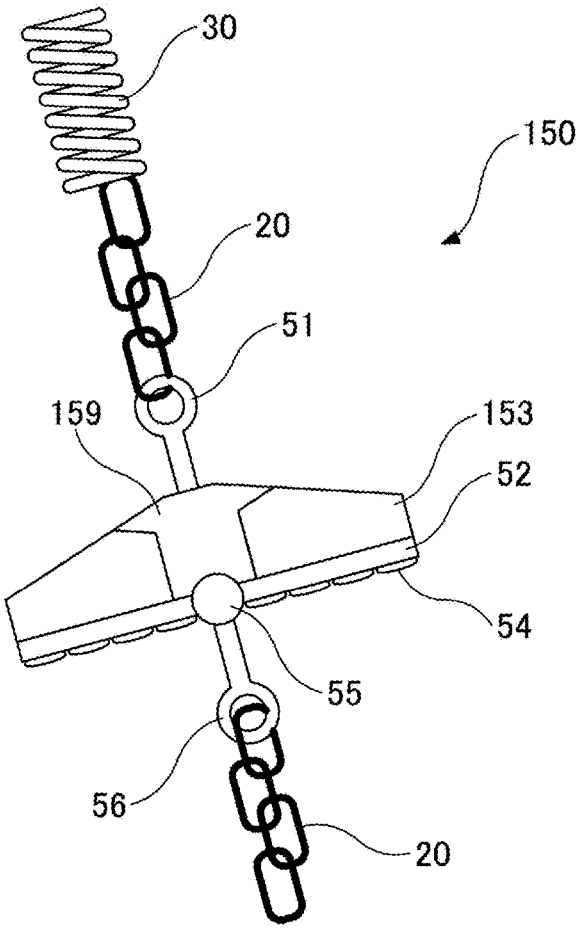
FIG. 26 is a view illustrating a state of the scraping ball when sludge is discharged in the hopper device illustrated in FIG. 1, in the case where the scraping ball having the metal cover attached to the upper surface of the scraping plate is used.

Thereafter, when all the sludge 2 stored in the hopper body 10 is discharged and the lock claw 71*b* is pulled out from the lock groove 52*b* in conjunction with the closing of the opening and closing gates 61*a* and 61*b* as illustrated in FIGS. 17 and 18, for example, and the scraping plate 52 is unlocked, the scraping plate 52 returns to the opened disc-like shape as illustrated in FIG. 26 because the elastic resin 159 is made of an elastic member.

When the entire weight of the scraping ball 50 increases by using the metal cover 153 and the force of the elastic resin 159 to return the scraping plate 52 to the disc-like shape is insufficient, the lock mechanism as described above may be combined with a return mechanism of the driving portion 55 for returning the scraping plate 52 from the folded state to the disc-like shape.

Figure 27:
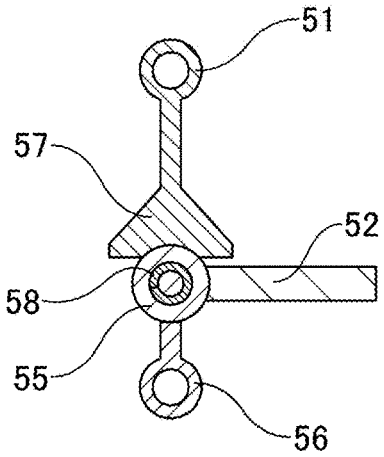
FIG. 27 is a view illustrating an example of a return mechanism of a driving portion for returning the scraping plate from a folded state to a disc-like shape.

FIG. 27 is a view illustrating an example of a return mechanism of the driving portion 55 for returning the scraping plate 52 from the folded state to the disc-like shape, which is a cross-sectional view in a direction orthogonal to the axial direction of the driving portion 55. In FIG. 27, only one of the regions of the scraping plate 52 which is opened and closed by the driving portion 55 is illustrated.

As illustrated in FIG. 27, a return spring 58 may be built in the driving portion 55. The return spring 58 is an example of a return unit in the present disclosure, and the scraping plate 52 is preloaded by the return spring 58 from a downwardly closed state to an opened state. Therefore, when the lock mechanism is released, the scraping plate 52 returns from the downwardly closed state to the opened state.

When the scraping plate 52 returns to the opened disc-like shape, the elastic resin 159 is provided between the two divided parts of the metal cover 153, and thus the sludge will not be interposed between the two divided parts of the metal cover 153 in a state where the scraping plate 52 is closed downward.

Other Embodiments

In another embodiment, a scraping ball may be used with the scraping plate kept closed.

Figure 28:
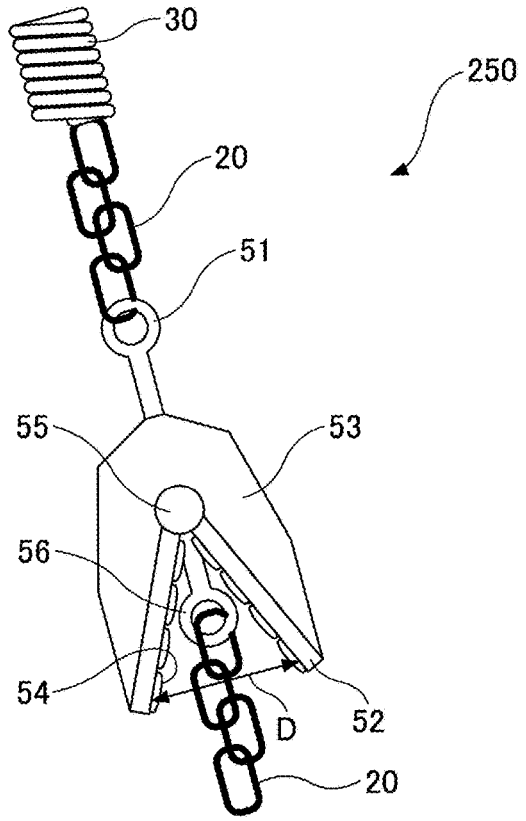
FIG. 28 is a view illustrating an operation when the scraping ball is used with the scraping plate closed.
Figure 29:
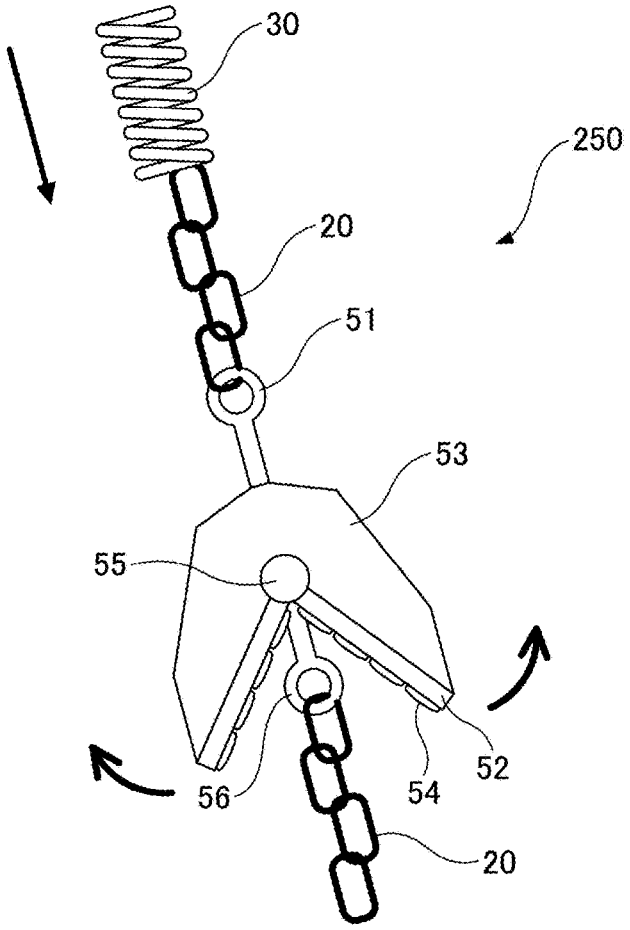
FIG. 29 is a view illustrating the operation when the scraping ball is used with the scraping plate closed.

FIGS. 28 and 29 are views illustrating the operation in the case of using the scraping ball with the scraping plate kept closed.

In the present embodiment, even in a state where the sludge is not stored in the hopper body 10, the scraping plate 52 is in a downwardly closed state as illustrated in FIG. 28. For example, the scraping plate 52 can be closed downward by adjusting the elastic force of the elastic member of the resin cover 53 to weaken the preloading force to allow the resin cover 53 to return to the disc-like shape.

From that state, sludge 2 is stored as a stored material in the hopper body 10; thereafter, when the opening and closing gates 61*a* and 61*b* are opened to discharge the sludge 2 stored in the hopper body 10 from the discharge port 60, the sludge 2 stored in the hopper body 10 is discharged from the discharge port 60. Further, the movable wire 20 is pulled downward and moved downward, and thus scraping balls 250 attached to the movable wire 20 are also moved downward.

At this point, each scraping ball 250 moves downward and is slightly opened as illustrated in FIG. 29, but the scraping plate 52 is closed downward and does not prevent the falling of the sludge 2, and thus the sludge 2 easily moves downward. Further, when the sludge 2 is stored, the scraping ball 250 prevents the sludge 2 from being easily stored at least below the scraping ball 250 with respect to the falling of the sludge 2, the scraping balls 250 prevent the falling of the sludge 2 and prevent the sludge 2 from being easily stored at least below the scraping balls 250, and thus the compaction state is alleviated as compared with the state in which the scraping balls 250 are not provided. Thus, the sludge 2 is prevented from being compacted in the hopper body 10, and the sludge 2 is easily discharged from the discharge port 60. Further, since the scraping plate 52 is maintained in the closed state, the volume of the sludge 2 stored in the hopper device 1 will not be greatly reduced.

In another embodiment, when each scraping ball 50 moves downward, the scraping plate 52 may not be closed downward but may maintain a disc-like shape. For example, the scraping plate 52 can maintain the disc-like shape by adjusting the elastic force of the elastic member of the resin cover 53 to increase the preloading force to allow the scraping plate 52 to return to the disc-like shape. Even in this case, a space is formed below each scraping ball 50, and thus the compaction state is inhibited. This facilitates discharge of the sludge 2 from the discharge port 60. Alternatively, for example, the above-described lock mechanism may be used to reliably maintain the disc-like shape. When the lock mechanism is used, the lock mechanism may maintain the disc-like shape while the opening and closing gates are in a closed state by the closing operation of the opening and closing operations, and the lock mechanism may be released simultaneously with the opening operation of the opening and closing gates to close the scraping plate 52 downward. A space that allows the scraping plate 52 to be closed downward can be present by maintaining the disc-like shape of the scraping plate 52 even after the sludge 2 is stored by preventing the falling of the stored sludge 2. Therefore, when the sludge 2 is discharged by the weight or falling of the sludge 2, the scraping plate 52 can be closed downward. This allows the scraping plate 52 to close downward when the sludge 2 is discharged due to the weight or falling of the sludge 2. The scraping plate 52 may automatically return to its disc-like shape as the sludge 2 is discharged, or the opening and closing gates may remain closed downward while the opening and closing gates are closed using the locking mechanism described above. When the resin cover 53 is preloaded to return to the disc-like shape as the sludge 2 is discharged or as the opening and closing gates are closed and the locked state is released, the resin cover 53 can be returned to the state of maintaining the disc-like shape at the time when the sludge 2 is discharged from the discharge port. In addition, when the lock mechanism is employed, the lock mechanism can return the opening and closing gates to the state of reliably maintaining the disc-like shape simultaneously with the closing operation of the opening and closing operation of the opening and closing gates to close the opening and closing gates.

As another embodiment, the elastic resin 159 may not be provided in the configuration illustrated in FIGS. 23 to 26.

Figure 30:
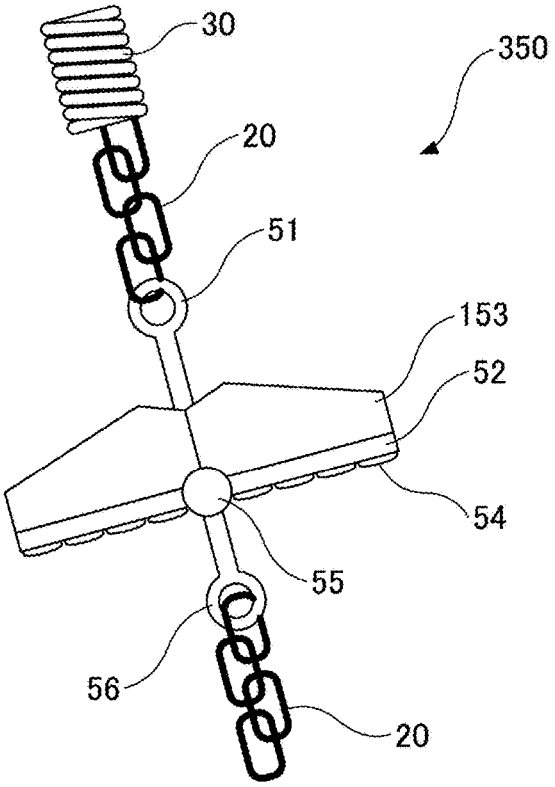
FIG. 30 is a view illustrating the operation in the case of using the scraping ball whose upper surface is made only of the metal cover.
Figure 31:
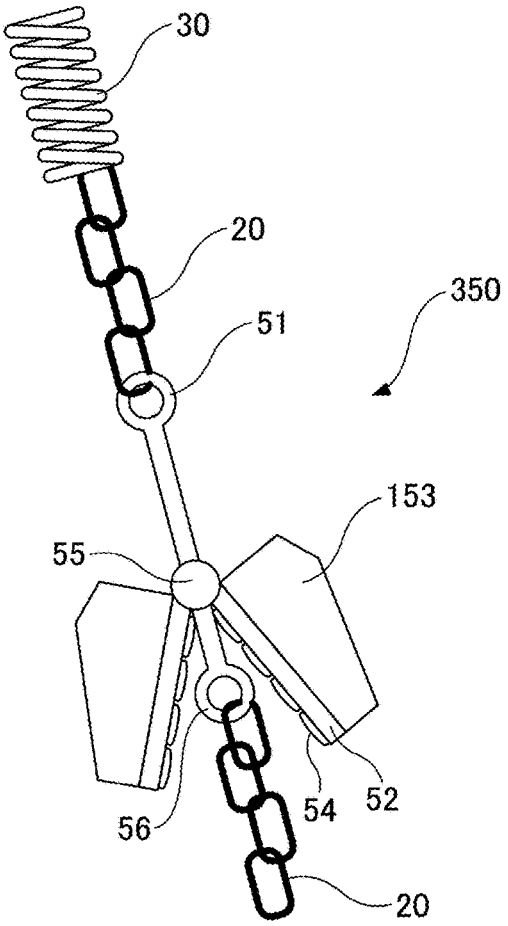
FIG. 31 is a view illustrating the operation in the case of using the scraping ball whose upper surface is made only of the metal cover.

FIGS. 30 and 31 are views illustrating an operation of a scraping ball in the case where an upper surface of the scraping ball is made only of the metal cover.

As illustrated in FIGS. 30 and 31, in a scraping ball 350 of the present embodiment, only a metal cover 153 is attached to the upper surface of the scraping plate 52. By adopting the configuration in which the metal cover 153 is attached to the upper surface of the scraping plate 52, the strength of the upper surface is secured, the effect of controlling the sludge is enhanced, and the durability of the scraping ball 350 can be improved, as compared with the configuration in which the resin cover 53 is attached to the upper surface of the scraping plate 52.

In this embodiment, when no sludge is stored in the hopper body 10, the scraping plate 52 is in the shape of an opened disc-like shape as illustrated in FIG. 30. A return mechanism, such as the return spring 58 described above, may be combined such that the scraping plate 52 is in the opened disc-like shape.

When the sludge as the stored material is stored in the hopper body 10 from this state, the sludge is deposited on the metal cover 153 of the scraping plate 52 because the scraping plate 52 has an opened disc-like shape. Since the metal cover 153 is divided into two regions by the driving portion 55, the scraping plate 52 is folded downward around the driving portion 55 due to the weight of the sludge as illustrated in FIG. 31. At this point, the metal cover 153 is inclined such that the height of the surface decreases from the center portion of the scraping plate 52 toward the end portion to form an umbrella shape, and thus the sludge deposited on the metal cover 153 easily falls.

Thereafter, when the opening and closing gates 61*a* and 61*b* are opened to discharge the sludge 2 stored in the hopper body 10 from the discharge port 60, the sludge 2 stored in the hopper body 10 is discharged from the discharge port 60. Further, the movable wire 20 is pulled downward and moved downward, and thus the scraping ball 350 attached to the movable wire 20 is also moved downward.

At this point, the scraping plate 52 is not in a disc-like shape but in a downwardly closed state such that each scraping ball 350 does not prevent the falling of the sludge 2, and thus the sludge 2 easily moves downward. Further, when the sludge 2 is stored, the scraping balls 350 maintain the disc-like shape for a certain period of time against the falling of the sludge 2 to prevent the sludge 2 from being easily stored below the scraping ball 350, and therefore, the compaction state is alleviated as compared with the state where the scraping balls 350 are not provided. Thus, the sludge 2 is prevented from being compacted in the hopper body 10, and the sludge 2 is easily discharged from the discharge port 60. In this case, the scraping plate 52 may be locked in the closed state as illustrated in FIG. 25. Thus, when the scraping ball 350 moves downward, the scraping plate 52 does not return to the opened disc-like shape.

After the sludge 2 stored in the hopper body 10 is all discharged, the scraping ball 350 is returned to the state illustrated in FIG. 30 by using the return spring 58 illustrated in FIG. 27. The return spring 58 in this case may have a restoring force that is lesser than the weight of the sludge stored on the scraping ball 350, allowing the scraping plate 52 to fold downwards to close while allowing the return spring 58 to return the scraping plate 52 to the opened state when the sludge is not stored on the scraping ball 35.

Although various embodiments have been described above by taking the storage of the sludge 2 as an example, the stored material is not limited to the sludge 2, and for example, other granular materials, powdery materials, and the like can be used. In addition to the similar bridging and compaction, the present disclosure can be applied to a storage material that causes similar effects, for example, clogging in storage of a container or the like. By appropriately adjusting the size, shape, length, and the like of the scraping balls and various elements according to the stored material, a preferred embodiment can be obtained within a range not contrary to the technical idea described above.

Further, although the hopper device 1 having four movable wires 20 each of which four scraping balls are attached is exemplified, it is needless to say that the numbers of the scraping balls and the wires as well as the size, shape and length of each of the scraping balls can be appropriately adjusted depending on the conditions of the stored material as described above. The present disclosure can be embodied in various forms without departing from the technical concept described above.

Furthermore, although the lock mechanism is configured to have two states of holding and releasing, or one state of holding or releasing, the number of states is not limited to this, and the lock mechanism may be configured to hold or release three or more states. The structure of the lock mechanism is not limited to that described in the embodiment, and the structure described in the embodiment is merely an example. The present disclosure can be embodied in various forms without departing from the technical concept described above.

Although embodiments of the present disclosure have been described above in detail, the present disclosure is not limited to such specific embodiments, and various alterations and modifications are possible within the scope of the claims as recited.

According to the present disclosure, the stored material can be easily discharged without using power of a motor or the like.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alternations could be made hereto without departing from the sprit and scope of the invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A hopper device comprising:

a hopper body having an opening and closing portion configured to open and close a discharge port provided on a lower surface of the hopper body to store a material;

at least one wire member having one end connected to the opening and closing portion and movable at least in a vertical direction in conjunction with an opening and closing operation of the discharge port by the opening and closing portion; and at least one compaction inhibiting member attached to the at least one wire member and movable at least in the vertical direction together with the at least one wire member in conjunction with the opening and closing operation of the discharge port by the opening and closing portion, wherein the at least one compaction inhibiting member is configured to be foldable from an opened state to a downwardly closed state.

2. The hopper device according to claim 1, further comprising a holding unit configured to hold the at least one compaction inhibiting member in the opened state or the downwardly closed state.

3. The hopper device according to claim 2, wherein the holding unit holds the at least one compaction inhibiting member in one of the opened state or the downwardly closed state, in conjunction with an opening and closing operation of the discharge port by the opening and closing portion.

4. The hopper device according to claim 2, wherein the holding unit holds the at least one compaction inhibiting member in both the opened state and the downwardly closed state, in conjunction with an opening and closing operation of the discharge port by the opening and closing portion.

5. The hopper device according to claim 2, wherein the holding unit holds the at least one compaction inhibiting member in the opened state or the downwardly closed state by removing a claw portion from a recess portion or inserting the claw portion into the recess portion, and the recess portion is provided in a shaft portion at which the at least one compaction inhibiting member opens and closes.

6. The hopper device according to claim 5, wherein the holding unit removes the claw portion from the recess portion and inserts the claw portion into the recess portion, in accordance with movement of the at least one compaction inhibiting member in the vertical direction.

7. The hopper device according to claim 5, wherein one end of a cable is connected to a fixed end, and the other end of the cable is connected to the claw portion.

8. The hopper device according to claim 5, wherein one end of a cable is connected to a mechanism that operates in conjunction with the opening and closing operation of the discharge port by the opening and closing portion, and the other end of the cable is connected to the claw portion.

9. The hopper device according to claim 1, wherein the at least one compaction inhibiting member comprises a returning unit configured to return the at least one compaction inhibiting member from the downwardly closed state to the opened state.

10. The hopper device according to claim 1, wherein the at least one compaction inhibiting member comprises a restricting member configured to prevent the at least one compaction inhibiting member from closing upward from the opened state.

11. The hopper device according to claim 1, wherein the at least one compaction inhibiting member is configured such that a gap is formed between end portions facing each other when the at least one compaction inhibiting member is folded downward from the opened state.

12. The hopper device according to claim 1, wherein the at least one compaction inhibiting member is provided with a protrusion on a lower surface of the at least one compaction inhibiting member.

13. The hopper device according to claim 1, wherein the at least one compaction inhibiting member comprises, on an upper surface of the at least one compaction inhibiting member, a cover member having a curved surface in the downwardly closed state.

14. The hopper device according to claim 13, wherein the cover member is made of an elastic member.

15. The hopper device according to claim 14, wherein the elastic member of the cover member has an elastic force that preloads the at least one compaction inhibiting member so as to return from the downwardly closed state to the opened state.

16. The hopper device according to claim 1, wherein the at least one compaction inhibiting member is made only of a metal layer having an inclined surface on an upper surface side.

17. The hopper device according to claim 1, wherein an upper surface of the at least one compaction inhibiting member is made of a metal layer and an elastic member.

18. The hopper device according to claim 1, wherein the opening and closing portion opens and closes the discharge port by moving in a horizontal direction.

19. The hopper device according to claim 1, wherein the opening and closing portion opens and closes two opening and closing gates in a double-door opening manner.

20. The hopper device according to claim 1, wherein the opening and closing portion opens and closes the discharge port by moving in a horizontal direction and the vertical direction.

21. The hopper device according to claim 1, further comprising:

a support member provided above the discharge port in the hopper body, wherein the other end of the at least one wire member is connected to the support member via a spring.

22. The hopper device according to claim 1, wherein the at least one compaction inhibiting member comprises a plurality of compaction inhibiting members attached to the at least one wire member.

23. The hopper device according to claim 22, wherein the at least one wire member comprises a plurality of wire members.

24. The hopper device according to claim 23, wherein the plurality of wire members are arranged so as to cross each other when the hopper device is viewed from a side.

* * * * *